US006136483A

United States Patent [19]

Suzuki et al.

[11] Patent Number: 6,136,483

[45] Date of Patent: Oct. 24, 2000

[54] ELECTROPHOTOGRAPHIC PHOTOCONDUCTOR AND ELECTROPHOTOGRAPHIC IMAGE FORMING APPARATUS USING THE PHOTOCONDUCTOR

[75] Inventors: Yasuo Suzuki, Fuji; Jun Aoto, Yokohama; Takehiko Kinoshita, Mishima, all of Japan

[73] Assignee: Ricoh Company, Ltd., Tokyo, Japan

[21] Appl. No.: 09/383,191

[22] Filed: Aug. 26, 1999

[30] Foreign Application Priority Data

Aug. 27, 1998 [JP] Japan ..... 10-256120
Sep. 8, 1998 [JP] Japan ..... 10-269078

[51] Int. Cl.[7] ..... G03G 5/047

[52] U.S. Cl. ..... 430/58.7; 430/59.2; 430/59.4; 399/297

[58] Field of Search ..... 430/58.7, 59.4, 430/83, 58.65, 59.2; 399/297

[56] References Cited

U.S. PATENT DOCUMENTS

| | | | |
|---|---|---|---|
| 5,389,477 | 2/1995 | Tsuchiya et al. . | |
| 5,561,016 | 10/1996 | Suzuki et al. | 430/59 |
| 5,578,405 | 11/1996 | Ikegami et al. | 430/59 |
| 5,665,500 | 9/1997 | Suzuki | 430/66 |
| 5,677,096 | 10/1997 | Suzuki | 430/59 |
| 5,853,935 | 12/1998 | Suzuki et al. | 430/59.6 |
| 5,871,876 | 2/1999 | Ikuno et al. | 430/59 |
| 5,928,828 | 7/1999 | Suzuki | 430/126 |
| 6,026,262 | 2/2000 | Kinoshita et al. | 430/58.05 |

FOREIGN PATENT DOCUMENTS

| | | |
|---|---|---|
| 0 552 740 | 7/1993 | European Pat. Off. . |
| 0 567 396 | 10/1993 | European Pat. Off. . |
| 0 632 332 | 1/1995 | European Pat. Off. . |

OTHER PUBLICATIONS

Abstract of Japanese Patent No. 1–177553 (Jul. 1989).
Abstract of Japanese Patent No. 1–270060 (Oct. 1989).
Abstract of Japanese Patent No. 7–128890 (May 1995).
Abstract of Japanese Patent No. 8–29998 (Feb. 1996).
Abstract of Japanese Patent No. 9–127711 (May 1997).

*Primary Examiner*—John Goodrow
*Attorney, Agent, or Firm*—Oblon, Spivak, McClelland, Maier & Neustadt, P.C.

[57] ABSTRACT

An electrophotographic photoconductor including an electroconductive substrate, and a charge generating layer including a charge generating material and a charge transporting layer including a charge transporting material, which are overlaid and which are formed overlying one side of the electroconductive substrate, wherein the charge generating material includes an asymmetric disazo pigment and a metal-free phthalocyanine pigment, and wherein a ratio of the asymmetric disazo pigment to the metal-free phthalocyanine pigment is from 1.5:1 to 5:1 by weight and the asymmetric disazo pigment has the following formula (I):

$$Cp_1—N=N—A—N=N—Cp_2 \quad (I)$$

wherein A represents a divalent group which is connected to each nitrogen atom of the adjacent azo groups through a carbon atom of said A group; and $Cp_1$ and $Cp_2$ independently represents a residual group of a coupler, wherein $Cp_1$ is different from $Cp_2$.

9 Claims, 2 Drawing Sheets

ELECTROPHOTOGRAPHIC PHOTOCONDUCTOR AND ELECTROPHOTOGRAPHIC IMAGE FORMING APPARATUS USING THE PHOTOCONDUCTOR

BACKGROUND OF THE INVENTION

1. Field of the Invention

The present invention relates to an electrophotographic photoconductor, and to an electrophotographic image forming apparatus such as copiers, facsimiles and printers, which include a photoconductor as an image carrier.

2. Discussion of the Background

Inorganic photoconductive materials such as selenium, cadmium sulfide and zinc oxide have been used for electrophotographic photoconductors. However, these materials have drawbacks such as having low photosensitivity and low heat stability, and being toxic. Therefore, currently organic photoconductors have been actively developed, and organic photoconductors having a photoconductive layer including a charge generating material and a charge transporting material are now in practical use in the market.

On the other hand, electrophotographic image forming apparatus such as laser printers and digital copiers, which use a laser diode as a light source, have been developed and practically used in addition to the current image forming apparatus. In order to allow a photoconductor to be commonly used for such various image forming apparatus, the photoconductor is required to have high photosensitivities over a broad wavelength range including the visible region and the near infrared region.

In attempting to develop such a photoconductor, methods in which two or more pigments each of which has a photosensitivity to a wavelength range different from those of the other pigments are used as a charge generating material have been proposed in, for example, Japanese Laid-Open Patent Publications Nos. 63-148264, 1-177553 and 1-270060.

When two or more pigments are used as a charge generating material, the range through which the resultant photoconductor has good photosensitivity widens. However, two or more energy levels are formed in the resultant charge generating layer, and therefore a combination of the characteristics of the pigments cannot be exhibited. Even when the formulation of the photoconductive layer is changed, it is difficult to obtain a photoconductor exhibiting an excellent combination of charge properties including high surface potential and low residual potential.

As to the light source used for image forming apparatus, laser diodes are typically used because of having advantages such as being small in size, low-priced, and easy to handle. The wavelength of the laser light emitted from the marketed laser diodes is limited to the near infrared region not less than 750 nm. Therefore, photoconductors used for these image forming apparatus are required to have photosensitivity over a wavelength range of from 750 to 850 nm.

Squarilium pigments, phthalocyanine pigments, eutectic complexes of a pyrylium dye and a polycarbonate, pyrrolopyrrole, azo pigments and the like are known as the organic photoconductive materials having the requisite properties mentioned above. Among these pigments, phthalocyanine pigments are actively developed for electrophotographic photoconductors because the pigments have absorption and photosensitivity over a relatively long wavelength region, and in addition, by changing the center metal and the crystal form of the phthalocyanine pigments, various kind of photoconductive materials can be prepared.

Up to now, an ϵ-type copper phthalocyanine pigment, an X-type metal-free phthalocyanine pigment, a τ-type metal-free phthalocyanine pigment, vanadyl phthalocyanine pigment and titanyl phthalocyanine are known as a phthalocyanine pigment having good photosensitivity. However, these phthalocyanine pigments are not satisfactory in the point of photosensitivity, charging ability and durability. Therefore phthalocyanine pigments which are improved in these properties are especially desired.

In Japanese Laid-Open Patent Publication No. 9-127711, it is attempted to solve the problems concerning charge properties by using an azo compound in combination with a phthalocyanine compound. However, concerning the image qualities such as black spots, the publication refers to only the initial image properties, and the resultant photoconductor still has a problem in that image qualities deteriorate when the images are repeatedly produced for a long time.

In addition, Japanese Laid-Open Patent Publications Nos. 7-128890 and 8-29998 have disclosed a combination of a metal-free phthalocyanine pigment with an asymmetric disazo pigment. The purpose of the invention is to attain panchromatic sensitivity and high sensitivity, and the improvement of durability in the properties such as charge properties, image qualities and adhering properties of the photoconductive layer, which is discussed in the present application is not described, or is insufficiently described therein. Therefore, the problems have not been satisfactorily improved.

Further, when a photoconductor provided in an image forming apparatus is often exposed to light (particularly to ultraviolet light) in such a case that a photoconductor unit or developer is changed or a jammed sheet is removed from the apparatus, a problem which occurs is that the charge properties of the photoconductor tends to deteriorate. This problem has not been improved.

Because of these reasons, a need exists for a photoconductor which has stable charge properties and can produce images having good image qualities even when repeatedly used and even after the photoconductor is exposed to light such as ultraviolet light.

SUMMARY OF THE INVENTION

Accordingly, an object of the present invention is to provide a photoconductor which has stable charge properties and which can produce images having good image qualities even when used for a long time.

Another object of the present invention is to provide a photoconductor which can keep good charge properties even after the photoconductor is exposed to light (particularly, ultraviolet light).

To achieve these objects, the present invention contemplates the provision of a photoconductor having an electroconductive substrate, and a photoconductive layer including at least a charge generating layer and a charge transporting layer, wherein the charge generating layer includes an asymmetric disazo pigment and a metal-free phthalocyanine pigment as a charge generating material, and wherein the ratio of the asymmetric disazo pigment to the metal-free phthalocyanine pigment is from 1.5:1 to 5:1 by weight and the asymmetric disazo pigment has the following formula (I):

$$Cp_1—N=N—A—N=N—Cp_2 \quad (I)$$

wherein A represents a divalent group which is connected to each nitrogen atom of the adjacent azo groups through a carbon atom of said A group; and Cp1 and Cp2 represent a residual group of a coupler, wherein Cp1 is different from Cp2.

The charge generating layer preferably includes a polyvinyl butyral resin serving as a binder resin. The ratio of the charge generating material to the polyvinyl butyral resin is preferably from 8:1 to 3:1 by weight. The butyralation degree of the butyral resin (the mole ratio of the polyvinyl butyral component in the butyral resin) is preferably less than 62% by mole.

More preferably, the asymmetric azo compound has the following formula (II):

(II)

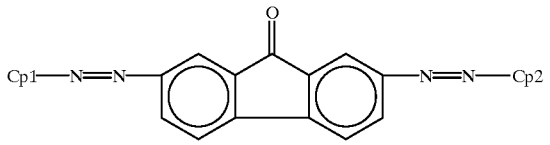

wherein Cp1 and Cp2 represent a residual group of a coupler, and wherein Cp1 is different from Cp2.

In addition, the metal-free phthalocyanine pigment includes τ-type or X-type metal-free phthalocyanine pigment.

Another aspect of the present invention is to provide an electrophotographic image forming apparatus including at least the photoconductor of the present invention.

These and other objects, features and advantages of the present invention will become apparent upon consideration of the following description of embodiments of the present invention in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like of corresponding parts throughout and wherein.

DETAILED DESCRIPTION OF THE INVENTION

Figure 1:
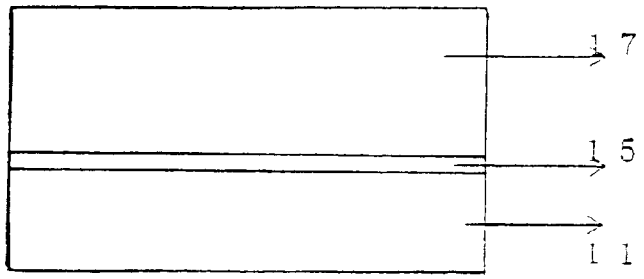
FIG. 1 is a schematic view illustrating a cross section of an embodiment of the photoconductor of the present invention.

Generally, the present invention provides a photoconductor having an electroconductive substrate, and a photoconductive layer including a charge generating layer and a charge transporting layer, wherein the charge generating layer includes an asymmetric disazo pigment and a metal-free phthalocyanine pigment, and wherein the ratio of the asymmetric disazo pigment to the metal-free phthalocyanine pigment is from 1.5:1 to 5:1 by weight and the asymmetric disazo pigment has the following formula (I):

(I)

wherein A represents a divalent group which is connected to each nitrogen atom of the adjacent azo groups through a carbon atom of said A group; and Cp1 and Cp2 represent a residual group of a coupler, wherein Cp1 is different from Cp2.

The charge generating layer preferably includes a polyvinyl butyral resin serving as a binder resin. The ratio of the charge generating material to the polyvinyl butyral resin is preferably from 8:1 to 3:1 by weight. The butyralation degree of the butyral resin (the mole ratio of the polyvinyl butyral component in the polyvinyl butyral resin) is preferably less than 62% by mole.

More preferably, the asymmetric disazo pigment includes a compound having the following formula (II);

(II)

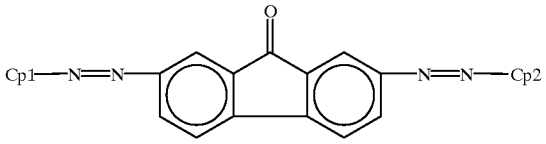

wherein Cp1 and Cp2 represent a residual group of a coupler, and wherein Cp1 is different from Cp2.

The metal-free phthalocyanine pigment preferably includes at least one of a τ-type metal-free phthalocyanine pigment and an X-type metal-free phthalocyanine pigment.

In addition, the charge transporting layer includes at least a charge transporting material and a binder resin wherein the charge transporting material includes a triphenylamine compound having the following formula (III):

(III)

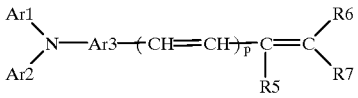

wherein Ar1 and Ar2 independently represent an aryl group which is optionally substituted, or an aromatic heterocyclic ring group which is optionally substituted; R5, R6 and R7 independently represent a hydrogen atom, an alkyl group which is optionally substituted, an alkoxy group which is optionally substituted, an aryl group which is optionally substituted, or a heterocyclic ring group which is optionally substituted, wherein R6 and R7 is optionally combined to form a ring; Ar5 represents an arylene group which is optionally substituted; and p is 0 or 1.

The photoconductor of the present invention preferably has an intermediate layer including a pigment and a binder resin wherein the pigment includes a titanium oxide.

The asymmetric disazo pigment having formula (I) of the present invention has very high sensitivity. The asymmetric disazo pigment can be prepared by reacting a corresponding diazonium salt compound with a coupler corresponding to group Cp1 and then reacting the product with a coupler corresponding to group Cp2. Alternatively, the asymmetric disazo pigment can be prepared by preparing and isolating a diazonium compound coupled with group Cp1 (or Cp2), and then reacting the coupled diazonium compound with a coupler corresponding to group Cp2 (or Cp1).

Specific examples of groups A, Cp1 and Cp2 include groups as shown in Table 1-1 and Tables 1-2 to 1-8.

TABLE 1-1
Specific examples of group A include the following groups
| No. | Formula |
|---|---|
| A-1 | 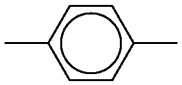 |
| A-2 | 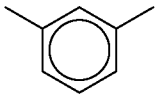 |
| A-3 | 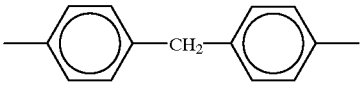  |
| A-4 | 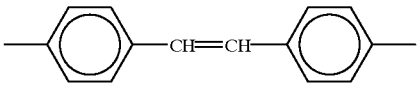  |
| A-5 | 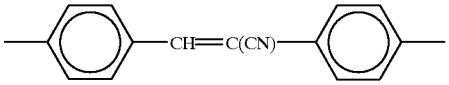  |
| A-6 | 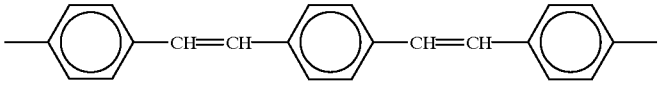  |
| A-7 | 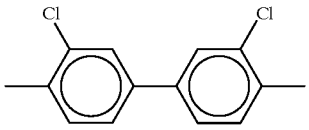  |
| A-8 | 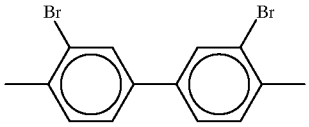  |
| A-9 | 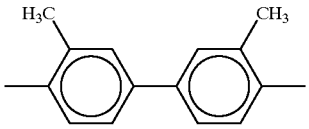  |
| A-10 | 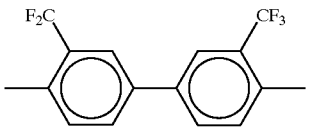  |
| A-11 | 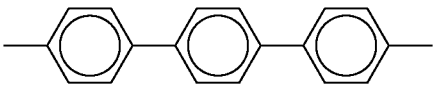 |
| A-12 | 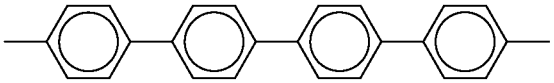 |

TABLE 1-1-continued
Specific examples of group A include the following groups
| No. | Formula |
|---|---|
| A-13 | 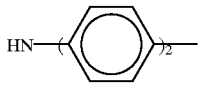 |
| A-14 | 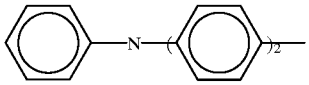 |
| A-15 | 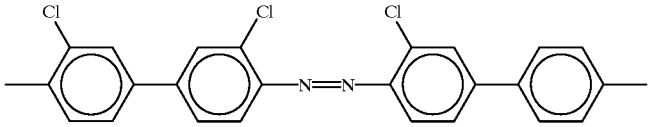 |
| A-16 | 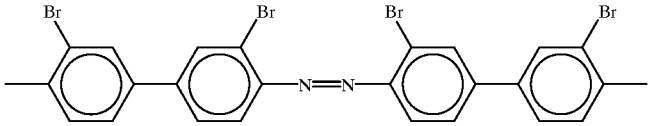 |
| A-17 | 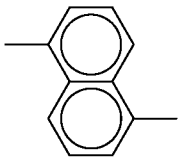 |
| A-18 | 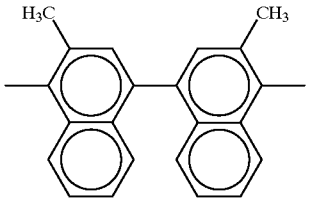 |
| A-19 | 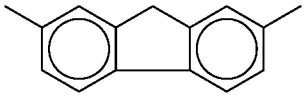 |
| A-20 | 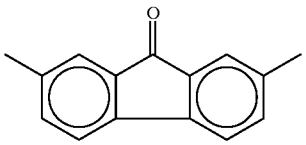 |
| A-21 | 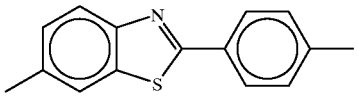 |
| A-22 | 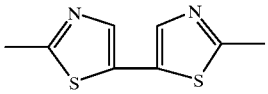 |

TABLE 1-1-continued
| Specific examples of group A include the following groups | |
|---|---|
| No. | Formula |
| A-23 | 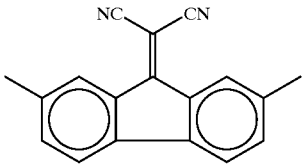 |
| A-24 | 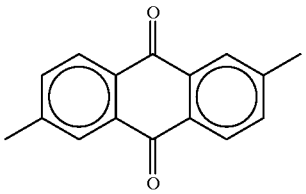 |
| A-25 | 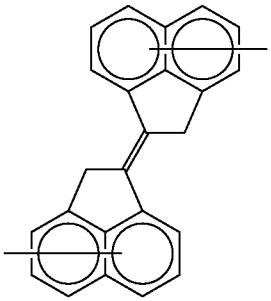 |
| A-26 | 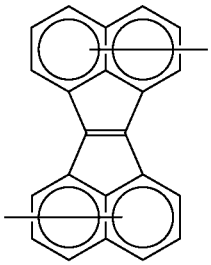 |
| A-27 | 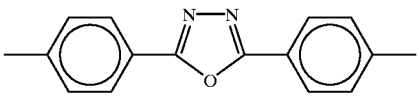 |
| A-28 | 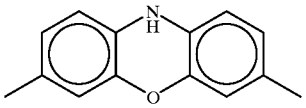 |
| A-29 | 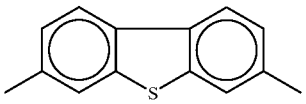 |

TABLE 1-1-continued

Specific examples of group A include the following groups

| No. | Formula |
|---|---|
| A-30 | 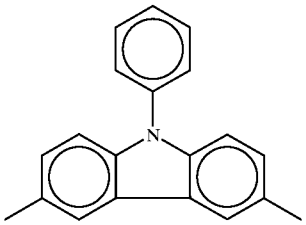 |

TABLE 1-2

Specific examples of groups Cp1 and Cp2 include groups having the following formula (C1)

(C1)

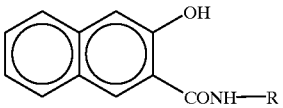

| No. | R |
|---|---|
| C1-1 | phenyl |
| -2 | 2-chlorophenyl |
| -3 | 3-chlorophenyl |
| -4 | 4-chlorophenyl |
| -5 | 2-nitrophenyl |
| -6 | 3-nitrophenyl |
| -7 | 4-nitrophenyl |
| -8 | 2-trifluoromethyl |
| -9 | 3-trifluoromethyl |
| -10 | 4-trifluoromethyl |
| -11 | 2-methylphenyl |
| -12 | 3-methylphenyl |
| -13 | 4-methylphenyl |
| -14 | 2-methoxyphenyl |
| -15 | 3-methoxyphenyl |
| -16 | 4-methoxyphenyl |
| -17 | 2-cyanophenyl |
| -18 | 3-cyanophenyl |
| -19 | 4-cyanophenyl |
| -20 | 1-naphthyl |
| -21 | 2-anthraquinolyl |
| -22 | 3,5-bistrifluoromethylphenyl |
| -23 | 4-pyrazolyl |
| -24 | 2-thiazolyl |
| -25 | 4-carboxyl-2-thiazolyl |
| -26 | 2-pyridyl |
| -27 | 2-pyrimidinyl |
| -28 | 2-carbazolyl |
| -29 | 2-quinolyl |

TABLE 1-3

Specific examples of groups Cp1 and Cp2 include groups having the following formula (C2)

(C2)

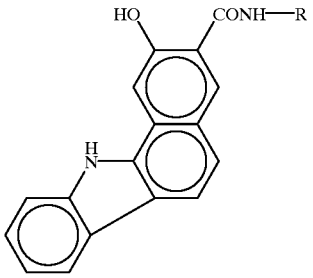

| No. | R |
|---|---|
| C2-1 | phenyl |
| -2 | 2-chlorophenyl |
| -3 | 3-chlorophenyl |
| -4 | 4-chlorophenyl |
| -5 | 2-nitrophenyl |
| -6 | 3-nitrophenyl |
| -7 | 4-nitrophenyl |
| -8 | 2-trifluoromethyl |
| -9 | 3-trifluoromethyl |
| -10 | 4-trifluoromethyl |
| -11 | 2-methylphenyl |
| -12 | 3-methylphenyl |
| -13 | 4-methylphenyl |
| -14 | 2-methoxyphenyl |
| -15 | 3-methoxyphenyl |
| -16 | 4-methoxyphenyl |
| -17 | 2-cyanophenyl |
| -18 | 3-cyanophenyl |
| -19 | 4-cyanophenyl |
| -20 | 1-naphthyl |
| -21 | 2-anthraquinolyl |
| -22 | 3,5-bistrifluoromethylphenyl |
| -23 | 4-pyrazolyl |
| -24 | 2-thiazolyl |
| -25 | 4-carboxyl-2-thiazolyl |
| -26 | 2-pyridyl |
| -27 | 2-pyrimidinyl |
| -28 | 2-carbazolyl |
| -29 | 2-quinolyl |

TABLE 1-4

Specific examples of groups Cp1 and Cp2 include groups having the following formula (C3)

(C3)

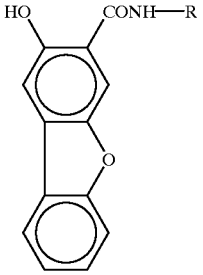

| No. | R |
|---|---|
| C1-1 | phenyl |
| -2 | 2-chlorophenyl |
| -3 | 3-chlorophenyl |
| -4 | 4-chlorophenyl |
| -5 | 2-nitrophenyl |
| -6 | 3-nitrophenyl |
| -7 | 4-nitrophenyl |
| -8 | 2-trifluoromethyl |
| -9 | 3-trifluoromethyl |
| -10 | 4-trifluoromethyl |
| -11 | 2-methylphenyl |
| -12 | 3-methylphenyl |
| -13 | 4-methylphenyl |
| -14 | 2-methoxyphenyl |
| -15 | 3-methoxyphenyl |
| -16 | 4-methoxyphenyl |
| -17 | 2-cyanophenyl |
| -18 | 3-cyanophenyl |
| -19 | 4-cyanophenyl |
| -20 | 1-naphthyl |
| -21 | 2-anthraquinolyl |
| -22 | 3,5-bistrifluoromethylphenyl |
| -23 | 4-pyrazolyl |
| -24 | 2-thiazolyl |
| -25 | 4-carboxyl-2-thiazolyl |
| -26 | 2-pyridyl |
| -27 | 2-pyrimidinyl |
| -28 | 2-carbazolyl |
| -29 | 2-quinolyl |

TABLE 1-5

Specific examples of groups Cp1 and Cp2 include groups having the following formula (C4)

(C4)

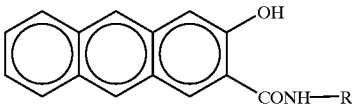

| No. | R |
|---|---|
| C4-1 | phenyl |
| -2 | 2-chlorophenyl |
| -3 | 3-chlorophenyl |
| -4 | 4-chlorophenyl |
| -5 | 2-nitrophenyl |
| -6 | 3-nitrophenyl |
| -7 | 4-nitrophenyl |
| -8 | 2-trifluoromethyl |
| -9 | 3-trifluoromethyl |
| -10 | 4-trifluoromethyl |
| -11 | 2-methylphenyl |
| -12 | 3-methylphenyl |

TABLE 1-5-continued

Specific examples of groups Cp1 and Cp2 include groups having the following formula (C4)

(C4)

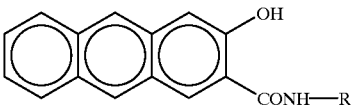

| No. | R |
|---|---|
| -13 | 4-methylphenyl |
| -14 | 2-methoxyphenyl |
| -15 | 3-methoxyphenyl |
| -16 | 4-methoxyphenyl |
| -17 | 2-cyanophenyl |
| -18 | 3-cyanophenyl |
| -19 | 4-cyanophenyl |
| -20 | 1-naphthyl |
| -21 | 2-anthraquinolyl |
| -22 | 3,5-bistrifluoromethylphenyl |
| -23 | 4-pyrazolyl |
| -24 | 2-thiazolyl |
| -25 | 4-carboxyl-2-thiazolyl |
| -26 | 2-pyridyl |
| -27 | 2-pyrimidinyl |
| -28 | 2-carbazolyl |
| -29 | 2-quinolyl |

TABLE 1-6

Specific examples of groups Cp1 and Cp2 include groups having the following formula (C5)

(C5)

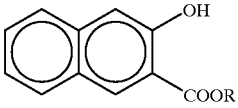

| No. | R |
|---|---|
| C5-1 | methyl |
| -2 | ethyl |
| -3 | propyl |
| -4 | isopropyl |
| -5 | butyl |
| -6 | isobutyl |
| -7 | sec-butyl |
| -8 | tert-butyl |
| -9 | pentyl |
| -10 | isoamyl |
| -11 | hexyl |
| -12 | heptyl |
| -13 | octyl |
| -14 | capryl |
| -15 | nonyl |
| -16 | decyl |
| -17 | undecyl |
| -18 | lauryl |
| -19 | tridecyl |
| -20 | pentadecyl |

TABLE 1-7

Specific examples of groups Cp1 and Cp2 include groups having the following formula (C6)

(6)

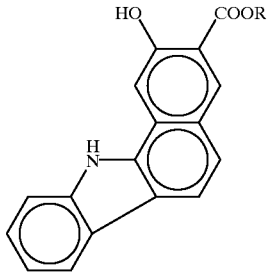

| No. | R |
|---|---|
| C6-1 | methyl |
| -2 | ethyl |
| -3 | propyl |
| -4 | isopropyl |
| -5 | butyl |
| -6 | isobutyl |
| -7 | sec-butyl |
| -8 | tert-butyl |
| -9 | pentyl |
| -10 | isoamyl |
| -11 | hexyl |
| -12 | heptyl |
| -13 | octyl |
| -14 | capryl |
| -15 | nonyl |
| -16 | decyl |
| -17 | undecyl |
| -18 | lauryl |
| -19 | tridecyl |
| -20 | pentadecyl |

TABLE 1-8

Specific examples of groups Cp1 and Cp2 include groups having the following formula (C7-1), (C7-2) or (C8)

| No. | |
|---|---|
| C7-1 | 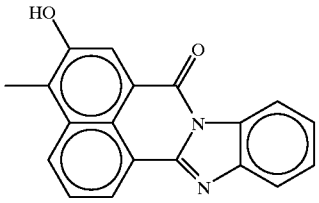 |
| C7-2 | 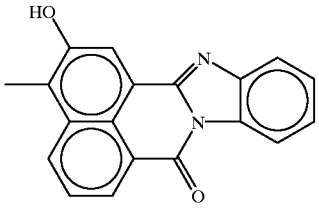 |
| C8 | 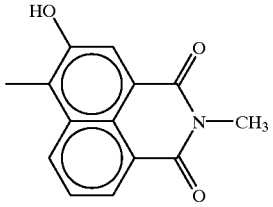 |

Among these asymmetric disazo pigments, compounds having formula (II), i.e., compounds having the fluorenone skeleton of A-20 as shown in Table 1-(1), are especially preferable because of having high sensitivity and good charge stability.

As to the metal-free phthalocyanine pigments, known metal-free phthalocyanine pigments can be employed in the present invention. Among the metal-free phthalocyanine pigments, X-type and τ-type metal-free phthalocyanine pigments are preferable. The reason is considered to be that the HOMO level of the X-type and τ-type metal-free phthalocyanine pigments is near the HOMO level of the asymmetric disazo pigments, and by mixing them they interact with each other, and therefore the sensitivity of the resultant photoconductor is effectively enhanced and in addition good charge properties such as low residual potential and high surface potential can be maintained even when the photoconductor is used for a long time.

The τ-type metal-free phthalocyanine pigment has an X-ray diffraction spectrum in which main peaks are observed at Bragg 2 θ angle of 7.6°, 9.2°, 16.8°, 17.4°, 20.4°, 20.9°, 21.7° and 27.6° (the tolerance of each angle is±0.2°) when a specific X-ray of Cu-K α (wavelength of 1.541 Å) irradiates the pigments. The τ-type metal-free phthalocyanine pigment can be prepared by a method described in, for example, Japanese Laid-Open Patent Publications Nos. 58-182639 and 60-19154.

The X-type metal-free phthalocyanine pigment has an X-ray diffraction spectrum in which main peaks are observed at Bragg 2 θ angle of 7.5°, 9.1°, 16.7°, 17.3°, 22.3° and 28.8° (the tolerance of each angle is±0.2°) when a specific X-ray of Cu-K α irradiates the pigments. The X-type metal-free phthalocyanine pigments can be prepared by a method described in, for example, U.S. Pat. Nos. 3,357,989 and 3,594,163, and Japanese Patent Publication No. 49-4338 and Japanese Laid-Open Patent Publication No. 60-243089.

The photoconductor of the present invention is a multilayer type photoconductor in which a photoconductive layer including at least a charge generating layer, which includes an asymmetric disazo pigment and a metal-free phthalocyanine pigment, and a charge transporting layer, is formed on an electroconductive substrate. The ratio of the asymmetric disazo pigment to the metal-free phthalocyanine pigment is preferably from 1.5:1 to 5:1 by weight so that the resultant photoconductor can maintain good charge properties and can produce good images without causing undesirable images such as background fouling and black spots even when used for a long time or exposed to light before image forming operations.

The ratio of the charge generating materials, which includes at least the asymmetric disazo pigment and the metal-free phthalocyanine pigment, to the binder resin in the charge generating layer is preferably from 8:1 to 3:1 by weight so that the resultant photoconductor can maintain good charge properties such as high sensitivity and low residual potential and can produce good images without causing undesirable images such as fouling even when used for a long time.

In addition, the binder resin preferably includes a butyral resin having a butyralation degree less than 62% by mole. The butyralation degree means the ratio of the polyvinyl butyral component (i.e., the vinyl butyral repeating unit) per total components (total repeating units) in a butyral resin.

By using a butyral resin having a butyralation degree less than 62% by mole as the binder resin in the charge generating layer, the resultant photoconductor has a stable surface potential (VD) and potential (VL) after light exposure, and in addition the resultant photoconductor can produce images having good image qualities without causing undesired images such as black spots. In addition, by using such a butyral resin, the resultant photoconductive layer has good adhesion to the substrate and the adjacent layers.

The butyralation degree of a butyral resin can be determined by analyzing an IR absorption spectrum obtained by infrared spectrophotometry.

The method of the butyralation degree of a butyral resin will be hereinafter explained in detail.

(1) one hundred and fifty milliliters (150 ml) of a mixed solvent of ethanol with toluene in a weight ratio of 1:1 is contained in a flask;

(2) a weighed butyral resin is added into the mixed solvent such that the resin content is 10.0±0.1% by weight;

(3) the flask including the mixture of the butyral resin and the mixed solvent is shaken for more than 3 hours to prepare a butyral resin solution;

(4) the solution is poured onto a polyethylene sheet, dried at room temperature (preliminary drying) and then dried in vacuum for 5 hours at a temperature of 65±5° C. under a pressure not greater than 50 mm Hg to prepare a film of the butyral resin (at this point, the thickness of the resultant film is controlled so as to be from 10 to 20 $\mu$m in order to control the transmittance of CH2 ν as at a wave number of 2980 $cm^{-1}$ so as to be from 10 to 45%);

(5) the resin film is peeled from the polyethylene sheet, and an IR absorption spectrum is obtained using an infrared spectrophotometer EPI-G3 Type manufactured by Hitachi Ltd.; and (6) the amounts of a hydroxy group and a residual acetyl group in the butyral resin is determined using a working curve which is preliminarily prepared.

The working curve is prepared as follows:

(1) the amount (% by weight) of each vinyl acetate component and vinyl butyral component in several polyvinyl butyral resins having a different butyralation degree is measured by a method based on JIS K6728 (polyvinyl butyral test method);

(2) the amount Wval (% by weight) of a vinyl alcohol component in each of the several polyvinyl butyral resins is determined by the following equation:

$$Wval=100-Wvac-Wvb \text{ (\% by weight)}$$

wherein Wvac (% by weight) represents the amount of a vinyl acetate component in a polyvinyl butyral resin and Wvb (% by weight) represents the amount of a vinyl butyral component in the polyvinyl butyral resin which are determined above;

(3) these amounts, Wval, Wvac and Wvb, are converted into the amounts having a unit of % by mole; and (4) a working curve (amount of vinyl alcohol of butyral resin vs. absorption) is prepared by plotting on the horizontal axis the amount of a vinyl alcohol component of each of the butyral resins and the film absorption thereof on the vertical axis, and similarly another working curve (amount of vinyl acetate of butyral resin vs. absorption) is also prepared.

The way how to obtain the amounts of a hydroxy group and a residual acetyl group in a butyral resin are as follows:

(1) a base line is formed in an IR absorption spectrum by drawing a line between a point having highest transparency near a wave number of 3900 $cm^{-1}$ and a point having highest transparency near a wave number of 2300 $cm^{-1}$, and another base line is formed by drawing a line between a point having highest transparency near a wave number of 1900 $cm^{-1}$ and a point having highest transparency near a wave number of 1600 $cm^{-1}$;

(2) the following absorbance D (i.e., log Io/I) is determined:

DOH at 3500 $cm^{-1}$;

DCH2 ν as at 2980 $cm^{-1}$;

DCH2 ν s at 2900 $cm^{-1}$; and

DCO at 1740 $cm^{-1}$.

(3) ratios of DOH/DCH2 ν as, DOH/DCH2 ν s, DCO/DCH2 ν as, and DCO/DCH2 ν s are calculated and the amounts of hydroxy group and residual acetyl group of the butyral resin are determined by the following formulae 1) and 2) using the working curve preliminarily prepared:

amount Mh of hydroxy group (% by mole) in the butyral resin =[(84.947×DOH/DCH2 ν as+6.45)+(64.851×DOH/DCH2 νs+3.63)]/2 1)

amount Ma of residual acetyl group (% by mole) in the butyral resin=[(18.87×DCO/DCH2 νas)+(12.48×DCO/DCH2 νs)]/2 2), and (4) the butyralation degree of the butyral resin is determined by the following equation:

$$\text{butyralation degree (\% by mole)}=100-(Mh+Ma).$$

The present invention will be explained in detail referring to drawings.

FIG. 1 is a schematic view illustrating a cross section of an embodiment of the electrophotographic photoconductor of the present invention. In FIG. 1, the photoconductor has a structure in which at least a charge generating layer 15 and a charge transporting layer 17 are overlaid on an electroconductive substrate 11.

Figure 2:
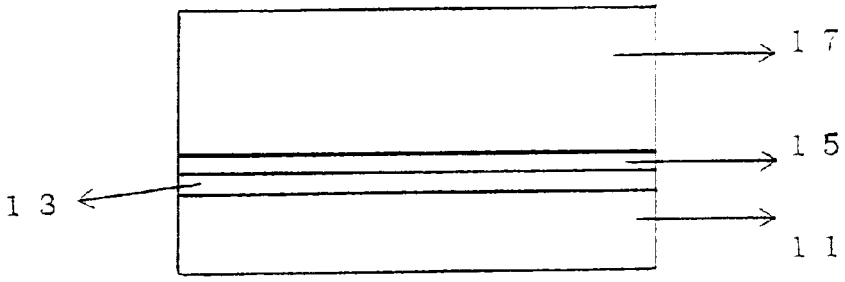
FIG. 2 is a schematic view illustrating a cross section of another embodiment of the photoconductor of the present invention.

FIG. 2 is a schematic view illustrating a cross section of another embodiment of the electrophotographic photoconductor of the present invention. In FIG. 2, an intermediate layer 13 is formed between an electroconductive substrate 11 and a charge generating layer 15 and a charge transporting layer 17 are overlaid on the intermediate layer 13.

Figure 3:
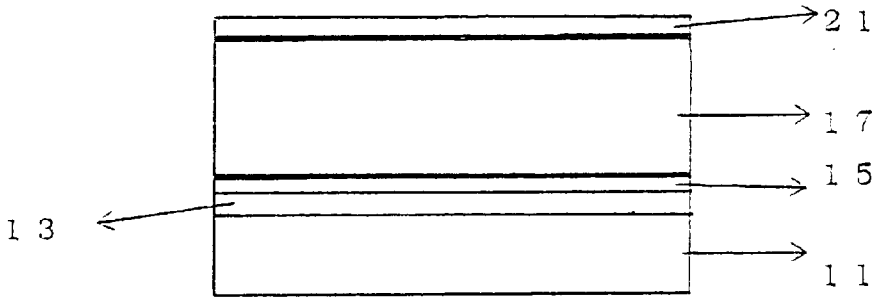
FIG. 3 is a schematic view illustrating a cross section of yet another embodiment of the photoconductor of the present invention.

FIG. 3 is a schematic view illustrating a cross section of yet another embodiment of the electrophotographic photoconductor of the present invention. In FIG. 3, a protective layer 21 is formed on a charge transporting layer 17.

In the present invention, a polyvinyl butyral resin serving as a binder resin, an asymmetric disazo pigment and a metal-free phthalocyanine pigment, which serve as a charge generating material, are included in the charge generating layer 15. The charge generating layer 15 can be formed by coating a charge generating layer coating liquid, in which the resin and the pigments are dispersed or dissolved, and then drying the coated liquid.

A suitable substrate for use in the photoconductor of the present invention includes a material having a volume resistivity less than $10^{10}\Omega\cdot m$. Specific examples of such a material include drums and sheets which are made of plastics and paper and whose surfaces are coated with a metal such as aluminum, nickel, chrome, nickel-chrome alloys, copper, silver, gold, platinum and the like, or a metal oxide such as tin oxide and indium oxide, by a vacuum evaporation method or a sputtering method. In addition, a plate of a metal such as aluminum, aluminum alloys, nickel stainless steel and the like and a tube which is made, for example, by preparing a rough tube of a metal mentioned above by an extruding or a drawing method and then treating the surface of the rough tube by cutting, super finishing and/or polishing can also be used. Further, an endless nickel belt and stainless belt, which are disclosed in, for example, Japanese Laid-Open Patent Publication No. 52-36016, can also be used as the electroconductive substrate 11.

In addition, substrates, which are made by coating on the above-mentioned supporters a coating liquid in which an electroconductive powder is dispersed in a binder resin solution, can also be used as the electroconductive substrate 11. Specific examples of the electroconductive powder include carbon black, acetylene black, metal powders such as aluminum, nickel, iron, nickel-chromium alloys, copper, zinc, and silver; and metal oxides such as electroconductive titanium oxides, electroconductive tin oxides, ITO and the like. Specific examples of the binder resin include thermoplastic resins, thermosetting resins or photo-crosslinking resins such as polystyrene resins, styrene-acrylonitrile copolymers, styrene-butadiene copolymers, styrene-maleic anhydride copolymers, polyester resins, polyvinyl chloride resins, vinyl chloride-vinyl acetate copolymers, polyvinyl acetate resins, polyvinylidene chloride resins, polyarylate resins, phenoxy resins, polycarbonate resins, cellulose acetate resins, ethyl cellulose resins, polyvinyl butyral resins, polyvinyl formal resins, polyvinyl toluene resins, poly-N-vinylcarbazole resins, acrylic resins, silicone resins, epoxy resins, melamine resins, urethane resins, phenolic resins, alkyd resins and the like. The electroconductive layer can be formed by coating a coating liquid in which one or more of the electroconductive powders and one or more of the binders resin are dispersed or dissolved in a proper solvent such as tetrahydrofuran, dichloromethane, 2-butanone, and toluene.

Further, substrates, which are made by forming an electroconductive layer on a cylindrical supporter using a heat shrinkable tube in which one or more of the electroconductive powders mentioned above are included in a resin such as polyvinyl chloride, polypropylene, polyester, polystyrene, polyvinylidene chloride, polyethylene, chlorinated rubbers, and fluorine-containing resins, can also be used as the electroconductive substrate 11.

The charge generating layer 15 has a structure in which a charge generating material including at least an asymmetric disazo pigment and a phthalocyanine pigment is dispersed in a binder resin. The charge generating layer 15 can be formed by coating a coating liquid, which is prepared by dispersing or dissolving these materials in a proper solvent with a ball mill, an attritor, a sand mill or a supersonic dispersing apparatus, on the electroconductive substrate 11 or the intermediate layer 13, and then drying the coated liquid.

Specific examples of the binder resins for use in the charge generating layer 15 include polyamide resins, polyurethane resins, epoxy resins, polyketone resins, polycarbonate resins, silicone resins, acrylic resins, polyvinyl formal resins, polyvinyl ketone resins, polystyrene resins, polyvinylcarbazole resins, polyacrylamide resins, polyvinyl butyral resins, polyvinyl benzal resins, polyester resins, phenoxy resins, vinyl chloride-vinyl acetate copolymers, polyvinyl acetate resins, polyamide resins, polyvinyl pyridine resins, cellulose resins, casein, polyvinyl alcohol resins, polyvinyl pyrrolidone resins and the like.

Among these resins, polyvinyl butyral resins are preferable, and butyral resins having a butyralation degree less than 62% by mole are more preferable.

The content of the binder resin is from 10 to 500 parts by weight, and preferably from 25 to 300 parts by weight, per 100 parts by weight of the charge generating material included in the charge generating layer 15.

The thickness of the charge generating layer 15 is from 0.01 to 5 $\mu$m, and preferably from 0.1 to 2 $\mu$m.

Suitable solvents for use in the charge generating layer coating liquid include isopropanol, acetone, methyl ethyl ketone, cyclohexanone, tetrahydrofuran, dioxane, ethyl cellosolve, ethyl acetate, methyl acetate, dichloromethane, monochlorobenzene, cyclohexane, toluene, xylene, ligroin and the like.

Suitable coating methods useful for coating a charge generating layer coating liquid include dip coating, spray coating, bead coating, nozzle coating, spin coating, ring coating and the like.

The charge transporting layer 17 can be formed by coating on the charge generating layer 15 a coating liquid in which a charge transporting material and a binder resin are dissolved or dispersed in a proper solvent, and drying the coated liquid. Additives such as plasticizers and antioxidants can be included in the coating liquid if desired.

The charge transporting materials are classified into positive-hole transporting materials and electron transporting materials.

Specific examples of the electron transporting materials include electron accepting materials such as chloranil, bromanil, tetracyanoethylene, tetracyanoquinodimethane, 2, 4, 7-trinitro-9-fluorenone, 2, 4, 5, 7-tetranitro-9-fluorenone, 2, 4, 5, 7-tetranitroxanthone, 2, 4, 8-trinitrothioxanthone, 2, 6, 8-trinitro-indeno-4H-indeno[1, 2-b]thiophene-4-one, 1, 3, 7-trinitrodibenzothiophene-5, 5-dioxide, benzoquinone derivatives and the like.

Specific examples of the positive-hole transporting materials include known materials such as poly-N-vinyl carbazole and its derivatives, poly-γ-carbazolylethylglutamate and its derivatives, pyreneformaldehyde condensation products and their derivatives, polyvinylpyrene, polyvinylphenanthrene, polysilane, oxazole derivatives, imidazole derivatives, monoaryl amine derivatives, diaryl amine derivatives, triaryl amine derivatives, stilbene derivatives, α-phenylstilbene derivatives, benzidine derivatives, diaryl methane derivatives, triaryl methane derivatives, 9-styryl anthracene derivatives, pyrazoline derivatives, divinyl benzene derivatives, hydrazone derivatives, indene derivatives, butadiene derivatives, pyrene derivatives, bisstilbene derivatives, enamine derivatives, polymerized positive-hole transporting materials and the like.

Among these materials, triphenyl amine compounds having formula (III) mentioned above are preferable because of having the following advantages:

(1) the compounds have large mobility and high sensitivity;

(2) the compounds themselves are hardly deteriorated by irradiation of light; and (3) the compounds exhibit good electrophotographic properties when used in combination with the charge generating material of the present invention including an asymmetric disazo pigment and a metal-free phthalocyanine pigment.

Specific examples of the compounds having formula (III) include compounds as shown in Table 2, but are not limited thereto.

(III)

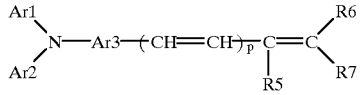

wherein p is 0 or 1.

TABLE 2
When p is 0, the specific examples of the compounds having the formula (III) include the following compounds
| compound No. | $Ar_1$ | $Ar_2$ | $Ar_3$ | $R_5$ | $R_6$ | $R_7$ |
|---|---|---|---|---|---|---|
| (III)-1 | 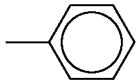 | 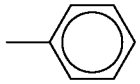 | 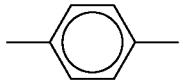 | —H | —H | 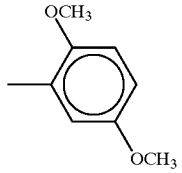  |
| (III)-2 | 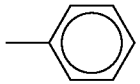 | 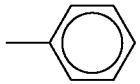 | 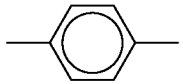 | —H | —H | 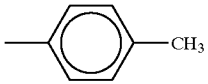  |
| (III)-3 | 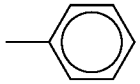 | 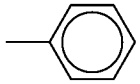 | 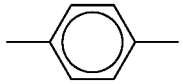 | —H | —H | 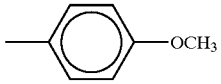  |
| (III)-4 | 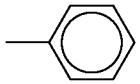 | 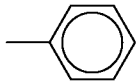 | 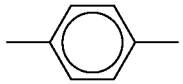 | —H | —H | 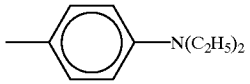  |
| (III)-5 | 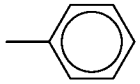 | 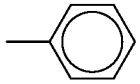 | 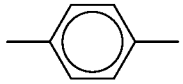 | —H | 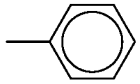 | 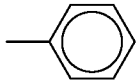 |
| (III)-6 | 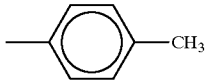  | 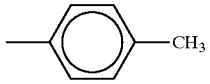  | 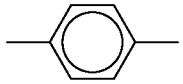 | —H | 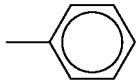 | 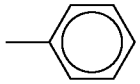 |
| (III)-7 | 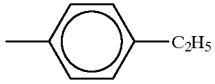  | 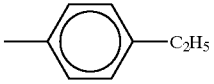  | 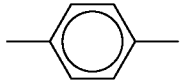 | —H | 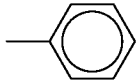 | 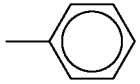 |
| (III)-8 | 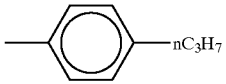  | 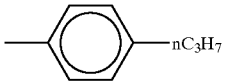  | 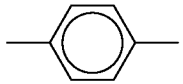 | —H | 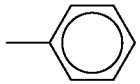 | 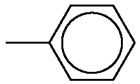 |

TABLE 2-continued
| | | | | | | |
|---|---|---|---|---|---|---|
| (III)-9 | 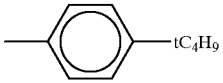 | 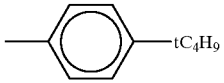 | 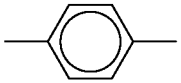 | —H | 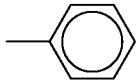 | 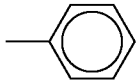 |
| (III)-10 | 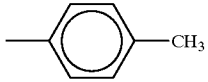 | 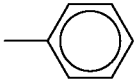 | 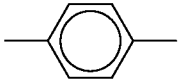 | —H | 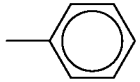 | 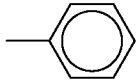 |
| (III)-11 | 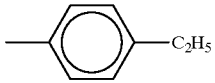 | 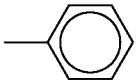 | 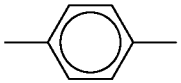 | —H | 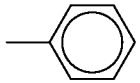 | 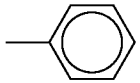 |
| (III)-12 | 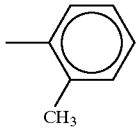 | 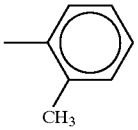 | 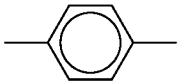 | —H | 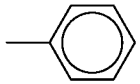 | 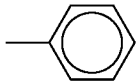 |
| (III)-13 | 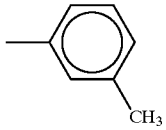 | 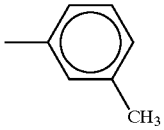 | 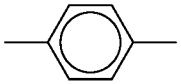 | —H | 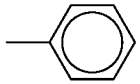 | 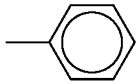 |
| (III)-14 | 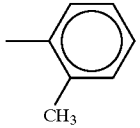 | 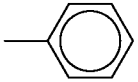 | 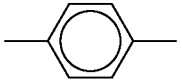 | —H | 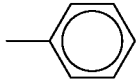 | 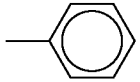 |
| (III)-15 | 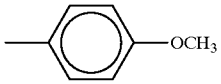 | 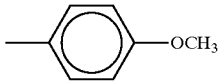 | 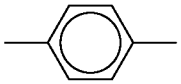 | —H | 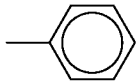 | 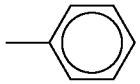 |

TABLE 2-continued
| | | | | | | |
|---|---|---|---|---|---|---|
| (III)-16 | 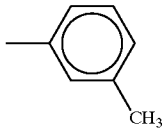 | 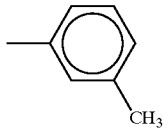 | 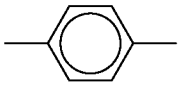 | —H | 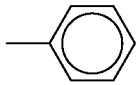 | 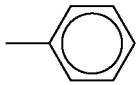 |
| (III)-17 | 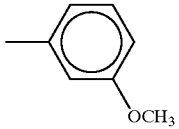 | 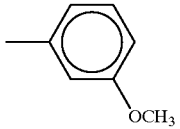 | 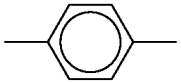 | —H | 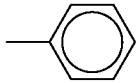 | 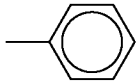 |
| (III)-18 | 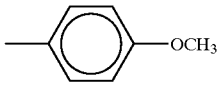 | 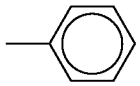 | 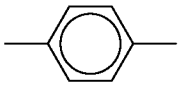 | —H | 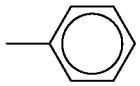 | 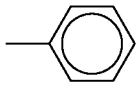 |
| (III)-19 | 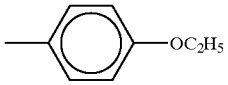 | 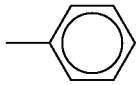 | 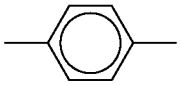 | —H | 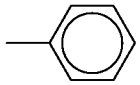 | 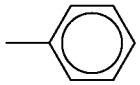 |
| (III)-20 | 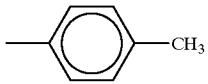 | 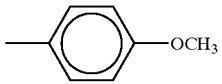 | 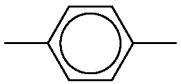 | —H | 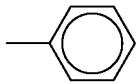 | 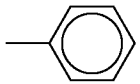 |
| (III)-21 | 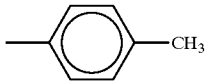 | 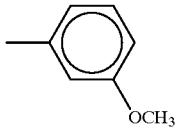 | 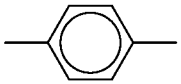 | —H | 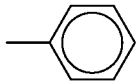 | 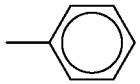 |
| (III)-22 | 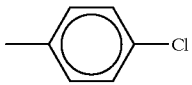 | 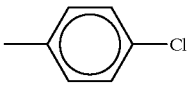 | 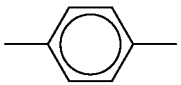 | —H | 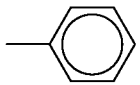 | 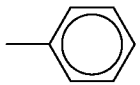 |
| (III)-23 | 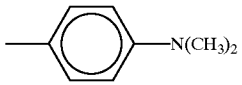 | 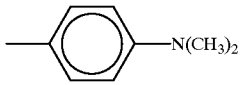 | 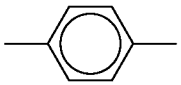 | —H | 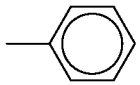 | 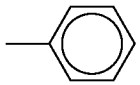 |

TABLE 2-continued
| | | | | | | |
|---|---|---|---|---|---|---|
| (III)-24 | 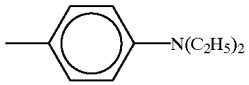 | 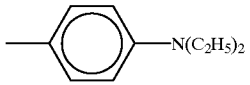 | 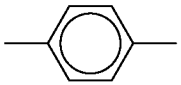 | —H | 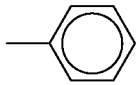 | 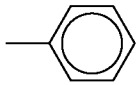 |
| (III)-25 | 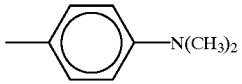 | 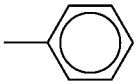 | 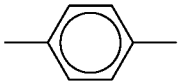 | —H | 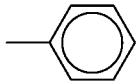 | 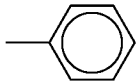 |
| (III)-26 | 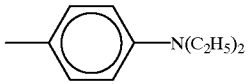 | 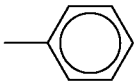 | 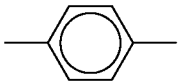 | —H | 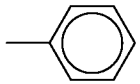 | 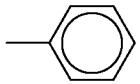 |
| (III)-27 | 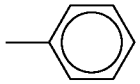 | 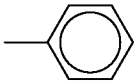 | 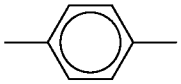 | —H | —H | 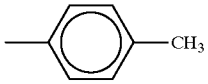 |
| (III)-28 | 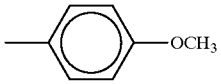 | 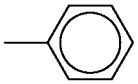 | 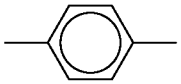 | —H | —H | 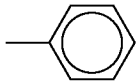 |
| (III)-29 | 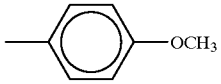 | 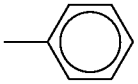 | 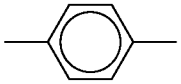 | —H | —H | 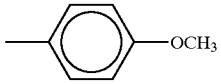 |
| (III)-30 | 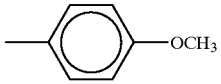 | 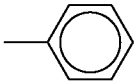 | 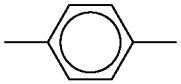 | —H | —H | 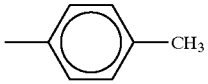 |
| (III)-31 | 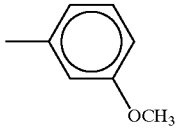 | 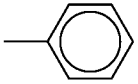 | 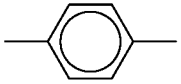 | —H | 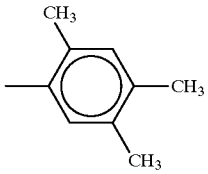 | 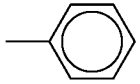 |

TABLE 2-continued
| | | | | | | |
|---|---|---|---|---|---|---|
| (III)-32 | 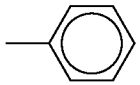 | 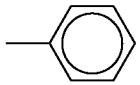 | 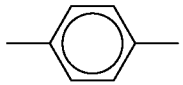 | —H | —H | 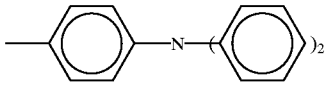 |
| (III)-33 | 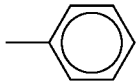 | 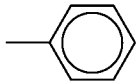 | 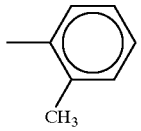 | —H | —H | 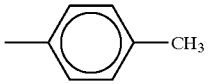 |
| (III)-34 | 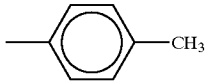 | 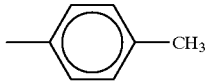 | 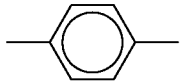 | —H | —H | 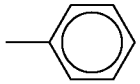 |
| (III)-35 | 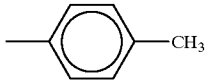 | 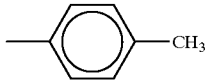 | 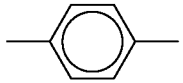 | —H | —H | 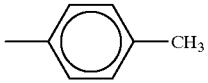 |
| (III)-36 | 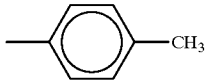 | 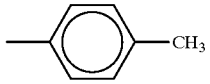 | 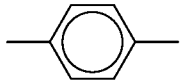 | —H | —H | 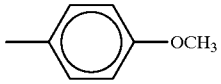 |
| (III)-37 | 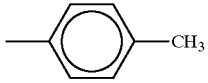 | 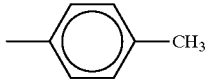 | 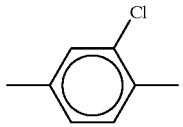 | —H | —H | 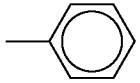 |
| (III)-38 | 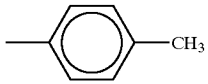 | 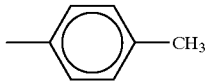 | 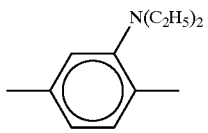 | —H | —H | 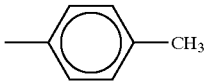 |
| (III)-39 | 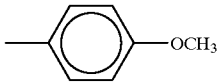 | 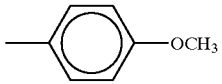 | 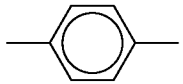 | —H | —H | 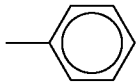 |

TABLE 2-continued
| | | | | | | |
|---|---|---|---|---|---|---|
| (III)-40 | 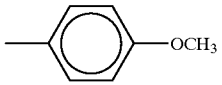 | 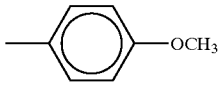 | 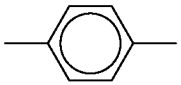 | —H | —H | 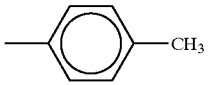 |
| (III)-41 | 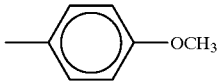 | 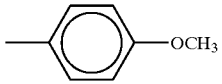 | 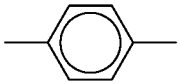 | —H | —H | 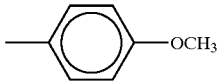 |
| (III)-42 | 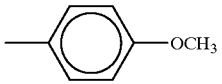 | 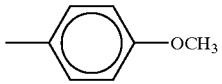 | 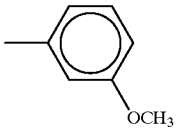 | —H | —H | 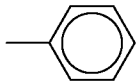 |
| (III)-43 | 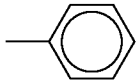 | 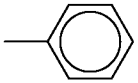 | 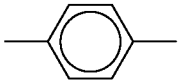 | —H | —H | 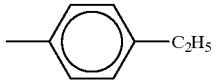 |
| (III)-44 | 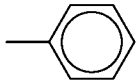 | 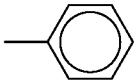 | 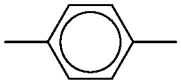 | —H | —H | 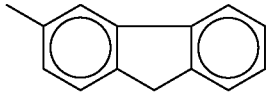 |
| (III)-45 | 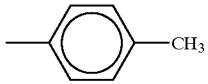 | 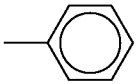 | 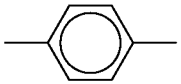 | —H | —H | 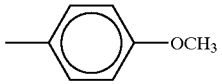 |
| (III)-46 | 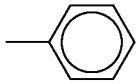 | 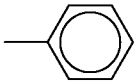 | 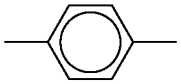 | —H | —H | 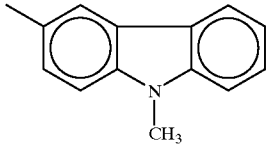 |
| (III)-47 | 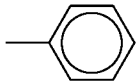 | 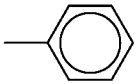 | 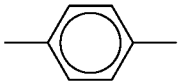 | —H | —H | 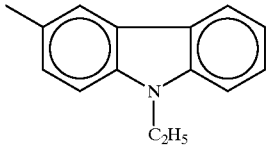 |

TABLE 2-continued
| | | | | | | |
|---|---|---|---|---|---|---|
| (III)-48 | 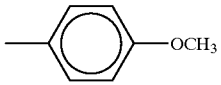 | 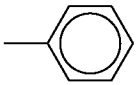 | 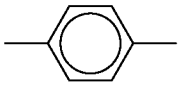 | —H | —H | 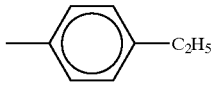 |
| (III)-49 | 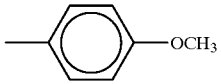 | 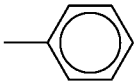 | 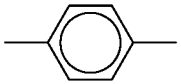 | —H | —H | 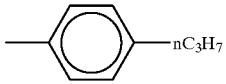 |
| (III)-50 | 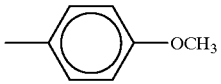 | 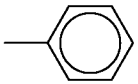 | 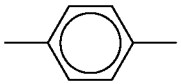 | —H | —H | 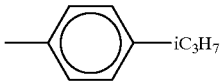 |
| (III)-51 | 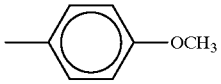 | 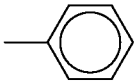 | 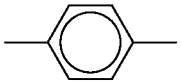 | —H | —H | 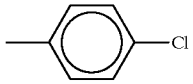 |
| (III)-52 | 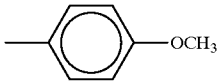 | 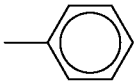 | 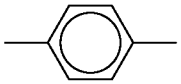 | —H | —H | 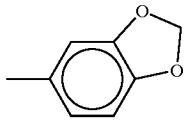 |
| (III)-53 | 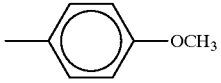 | 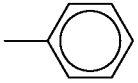 | 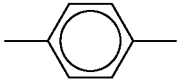 | —H | —H | 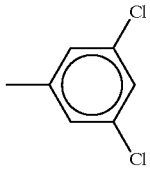 |
| (III)-54 | 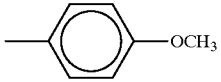 | 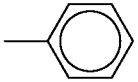 | 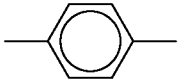 | —H | —H | 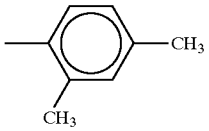 |

TABLE 2-continued
| | | | | | | |
|---|---|---|---|---|---|---|
| (III)-55 | 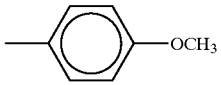 | 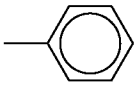 | 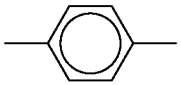 | —H | —H | 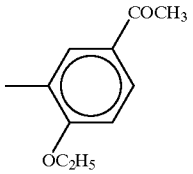 |
| (III)-56 | 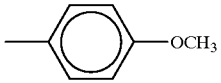 | 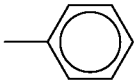 | 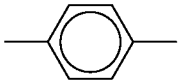 | —H | —H | 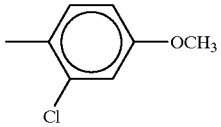 |
| (III)-57 | 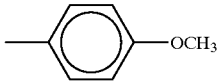 | 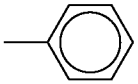 | 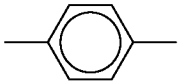 | —H | —H | 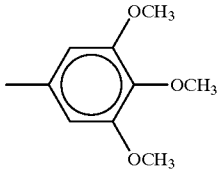 |
| (III)-58 | 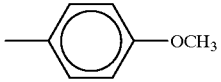 | 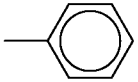 | 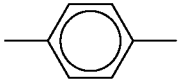 | —H | —H | 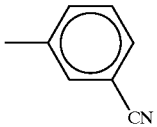 |
| (III)-59 | 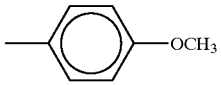 | 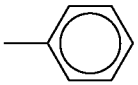 | 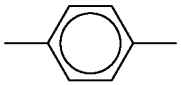 | —H | —H | 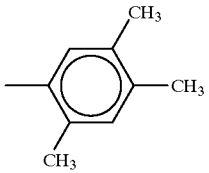 |
| (III)-60 | 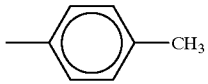 | 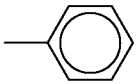 | 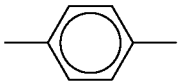 | —H | —H | 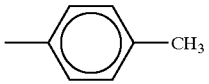 |

TABLE 2-continued
| | | | | | | |
|---|---|---|---|---|---|---|
| (III)-61 | 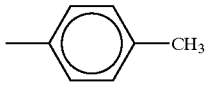 | 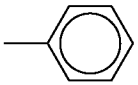 | 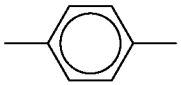 | —H | —H | 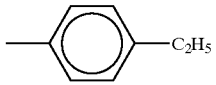 |
| (III)-62 | 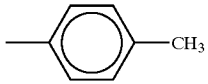 | 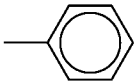 | 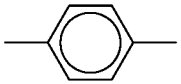 | —H | —H | 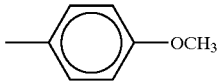 |
| (III)-63 | 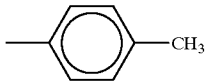 | 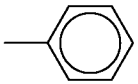 | 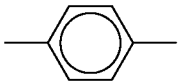 | —H | —H | 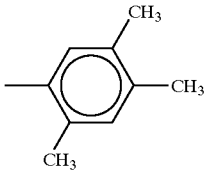 |
| (III)-64 | 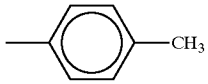 | 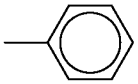 | 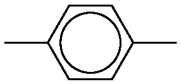 | —H | —H | 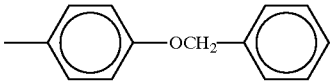 |
| (III)-65 | 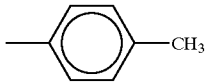 | 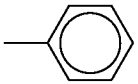 | 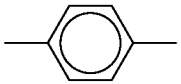 | —H | —H | 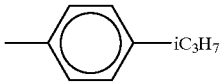 |
| (III)-66 | 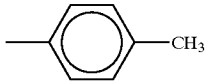 | 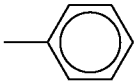 | 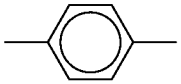 | —H | —H | 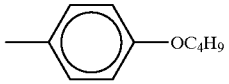 |
| (III)-67 | 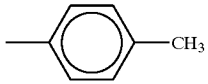 | 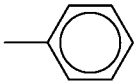 | 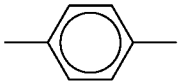 | —H | —H | 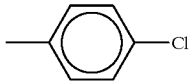 |
| (III)-68 | 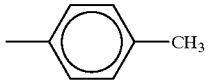 | 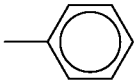 | 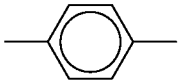 | —H | —H | 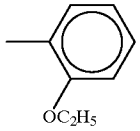 |

TABLE 2-continued
| | | | | | | |
|---|---|---|---|---|---|---|
| (III)-69 | 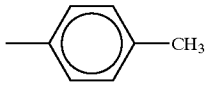 | 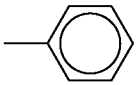 | 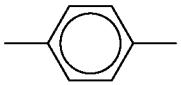 | —H | —H | 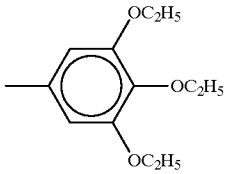 |
| (III)-70 | 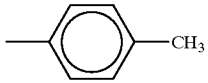 | 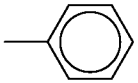 | 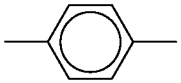 | —H | —H | 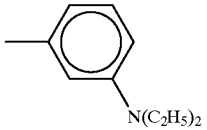 |
| (III)-71 | 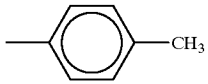 | 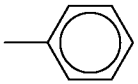 | 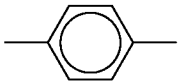 | —H | —H | 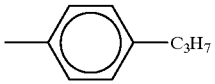 |
| (III)-72 | 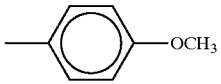 | 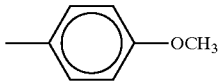 | 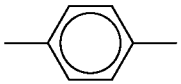 | —H | —H | 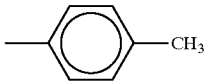 |
| (III)-73 | 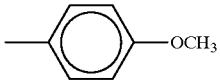 | 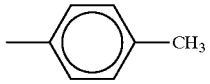 | 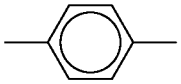 | —H | —H | 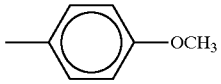 |
| (III)-74 | 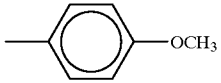 | 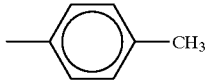 | 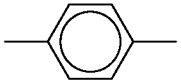 | —H | —H | 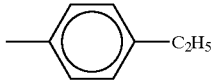 |
| (III)-75 | 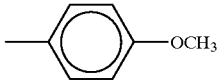 | 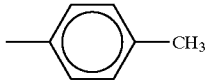 | 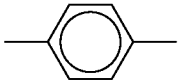 | —H | —H | 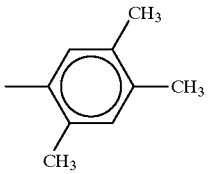 |

TABLE 2-continued
| | | | | | | |
|---|---|---|---|---|---|---|
| (III)-76 | 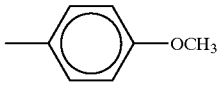 | 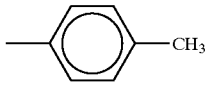 | 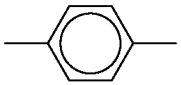 | —H | —H | 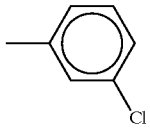 |
| (III)-77 | 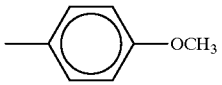 | 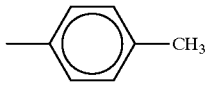 | 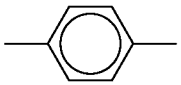 | —H | —H | 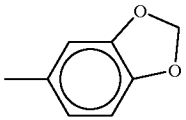 |
| (III)-78 | 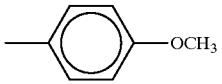 | 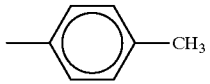 | 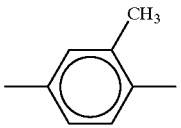 | —H | —H | 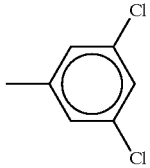 |
| (III)-79 | 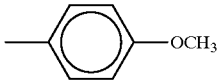 | 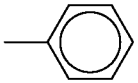 | 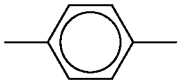 | —H | —H | 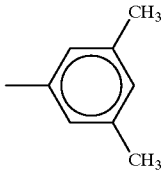 |
| (III)-80 | 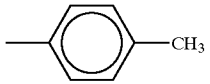 | 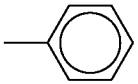 | 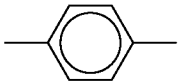 | —H | —H | 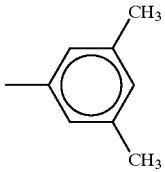 |
| (III)-81 | 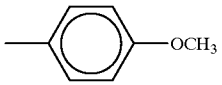 | 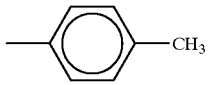 | 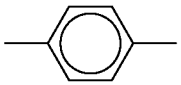 | —H | —H | 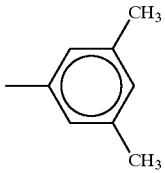 |

TABLE 2-continued
| | | | | | | |
|---|---|---|---|---|---|---|
| (III)-82 | 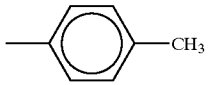 | 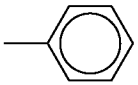 | 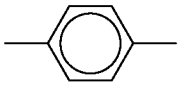 | —H | —H | 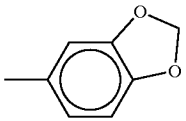 |
| (III)-83 | 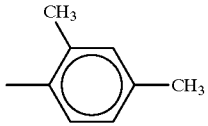 | 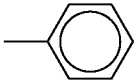 | 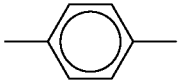 | —H | —H | 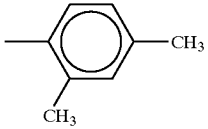 |
| (III)-84 | 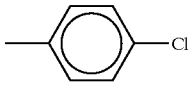 | 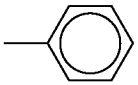 | 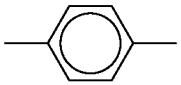 | —H | —H | 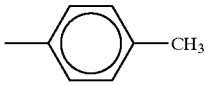 |
| (III)-85 | 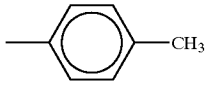 | 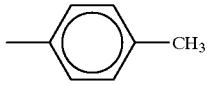 | 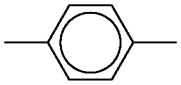 | —H | —H | 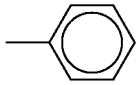 |
| (III)-86 | 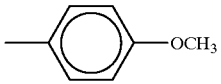 | 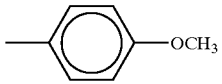 | 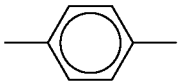 | —H | —H | 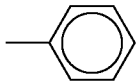 |
| (III)-87 | 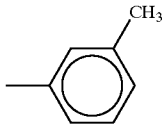 | 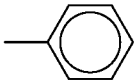 | 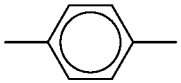 | —H | 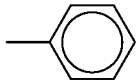 | 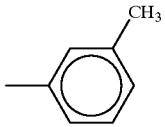 |
| (III)-88 | 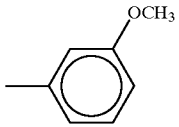 | 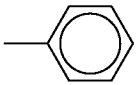 | 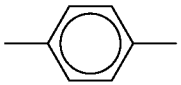 | —H | 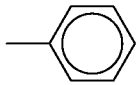 | 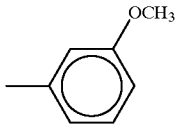 |
| (III)-89 | 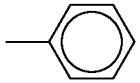 | 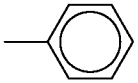 | 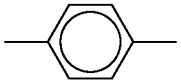 | —H | 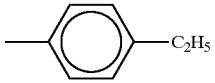 | 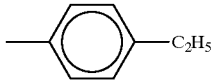 |

TABLE 2-continued
| | | | | | | |
|---|---|---|---|---|---|---|
| (III)-90 | 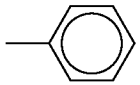 | 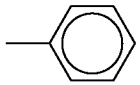 | 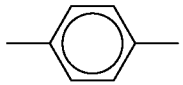 | —H | —H | 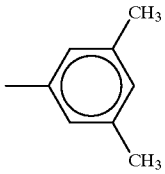  |
| (III)-91 | 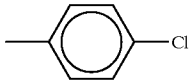  | 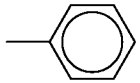 | 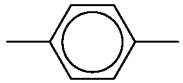 | —H | —H | 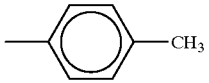  |
| (III)-92 | 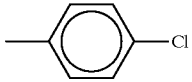  | 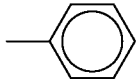 | 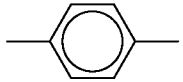 | —H | 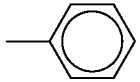 | 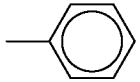 |
| (III)-93 | 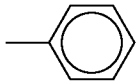 | 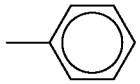 | 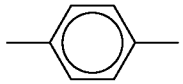 | —H | 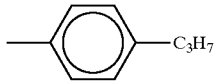  | 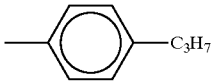  |
| (III)-94 | 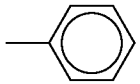 | 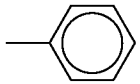 | 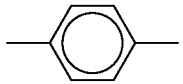 | —H | —H | 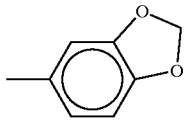  |
| (III)-95 | 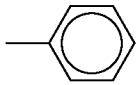 | 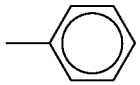 | 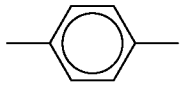 | —H | 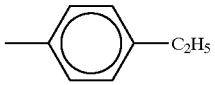  | 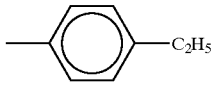  |
| (III)-96 | 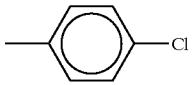  | 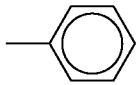 | 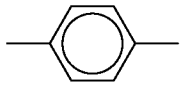 | —H | —H | 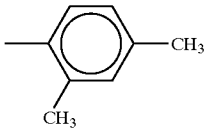  |

TABLE 2-continued
| | | | | | | |
|---|---|---|---|---|---|---|
| (III)-97 | 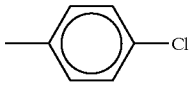 | 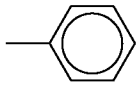 | 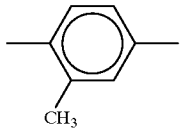 | —H | 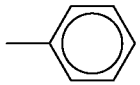 | 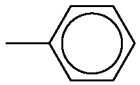 |
| (III)-98 | 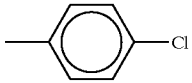 | 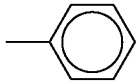 | 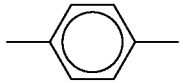 | —H | —H | 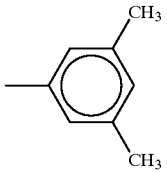 |
| (III)-99 | 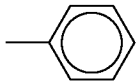 | 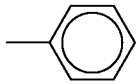 | 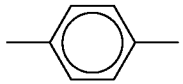 | —H | —H | 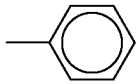 |
| (III)-100 | 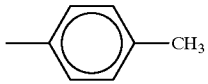 | 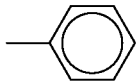 | 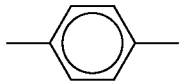 | —H | —H | 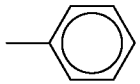 |
| (III)-101 | 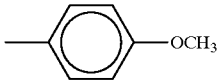 | 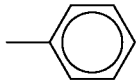 | 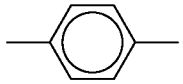 | —H | 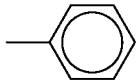 | 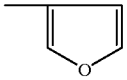 |
| (III)-102 | 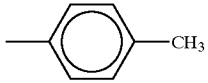 | 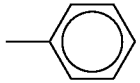 | 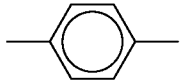 | —H | —H | 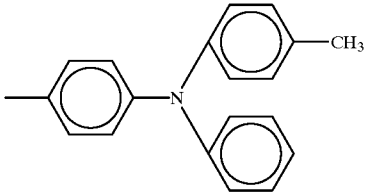 |
| (III)-103 | 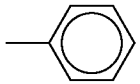 | 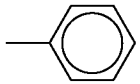 | 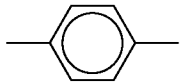 | —H | 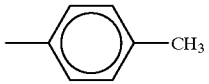 | 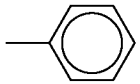 |

TABLE 2-continued
| | | | | | | |
|---|---|---|---|---|---|---|
| (III)-104 | 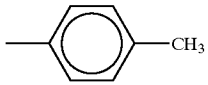 | 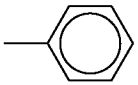 | 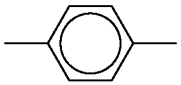 | —H | 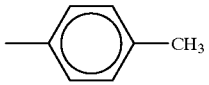 | 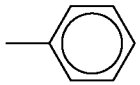 |
| (III)-105 | 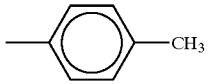 | 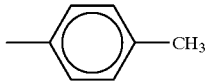 | 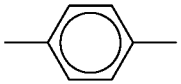 | —H | 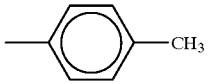 | 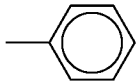 |
| (III)-106 | 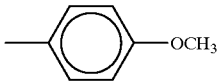 | 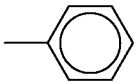 | 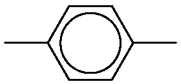 | —H | 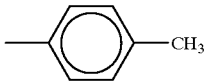 | 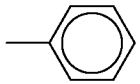 |
| (III)-107 | 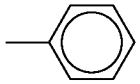 | 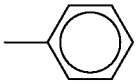 | 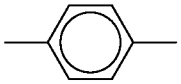 | —H | 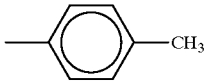 | 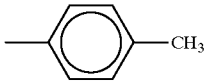 |
| (III)-108 | 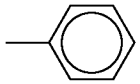 | 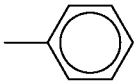 | 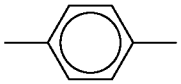 | —H | 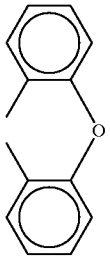 | |
| (III)-109 | 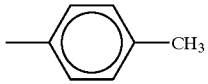 | 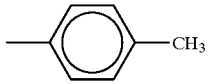 | 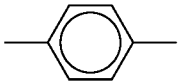 | —H | 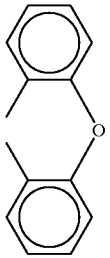 | |

TABLE 2-continued
| | | | | | |
|---|---|---|---|---|---|
| (III)-110 | 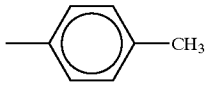 | 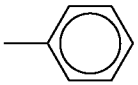 | 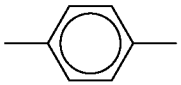 | —H | 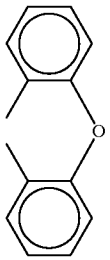 |
| (III)-111 | 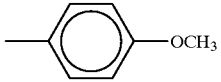 | 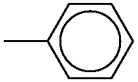 | 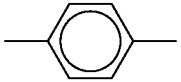 | —H | 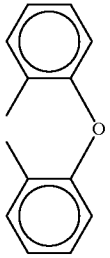 |
| (III)-112 | 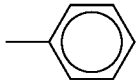 | 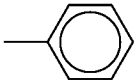 | 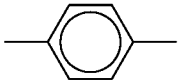 | —H | 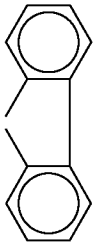 |
| (III)-113 | 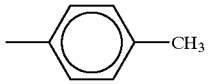 | 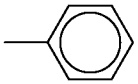 | 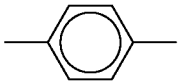 | —H | 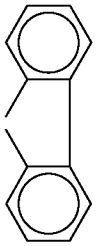 |

TABLE 2-continued
| | | | | | |
|---|---|---|---|---|---|
| (III)-114 | 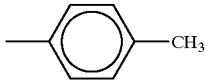 | 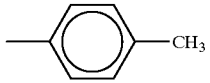 | 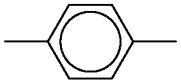 | —H | 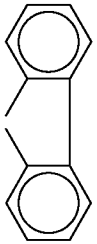 |
| (III)-115 | 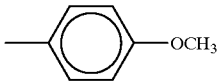 | 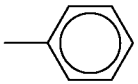 | 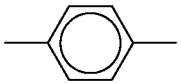 | —H | 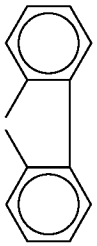 |
| (III)-116 | 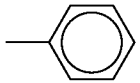 | 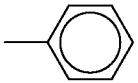 | 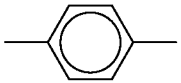 | —H | 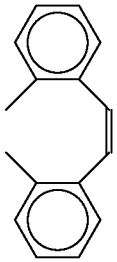 |

TABLE 2-continued
| | | | | | |
|---|---|---|---|---|---|
| (III)-117 | 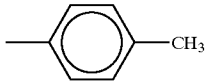 | 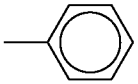 | 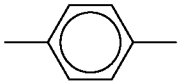 | —H | 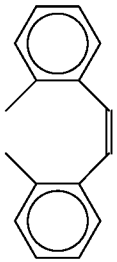 |
| (III)-118 | 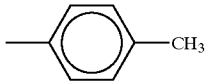 | 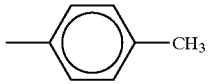 | 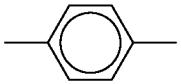 | —H | 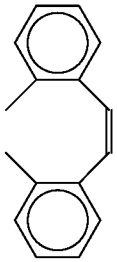 |
| (III)-119 | 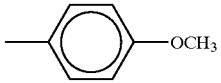 | 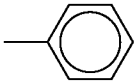 | 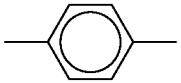 | —H | 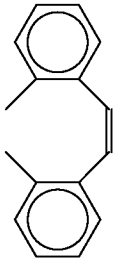 |
| Comp. No. | Formula |
|---|---|
| III-120 | 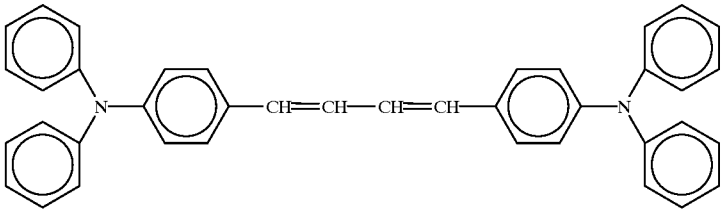 |

III-121
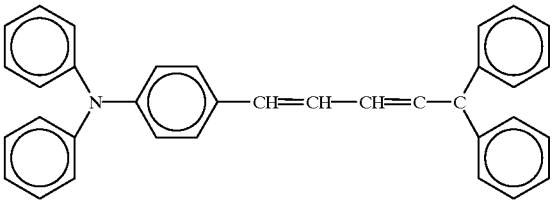
III-122
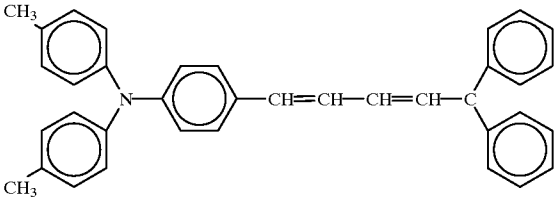
III-123
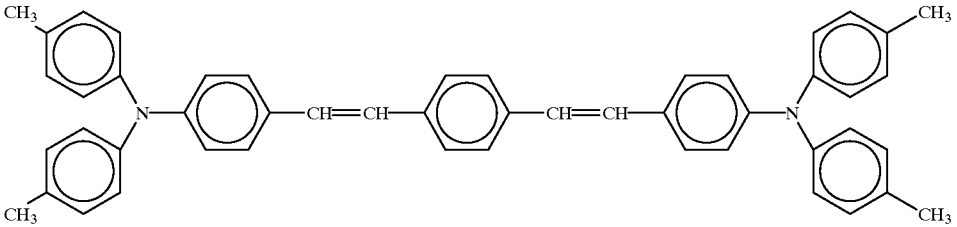
III-124
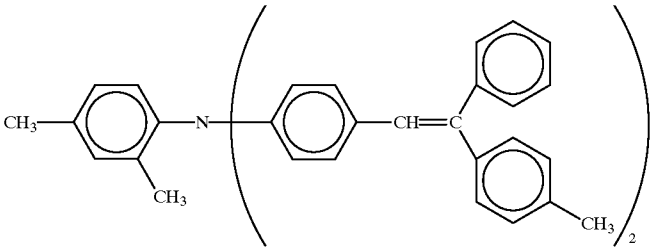

Specific examples of the binder resins for use in the charge transporting layer 17 include thermoplastic resins and thermosetting resins such as polystyrene resins, styrene-acrylonitrile copolymers, styrene-butadiene copolymers, styrene-maleic anhydride copolymers, polyester resins, polyvinyl chloride resins, vinyl chloride-vinyl acetate copolymers, polyvinyl acetate resins, polyvinylidene chloride resins, polyarylate resins, phenoxy resins, polycarbonate resins, cellulose acetate resins, ethyl cellulose resins, polyvinyl butyral resins, polyvinyl formal resins, polyvinyl toluene resins, poly-N-vinylcarbazole resins, acrylic resins, silicone resins, epoxy resins, melamine resins, urethane resins, phenolic resins, alkyd resins, and polycarbonate copolymers, which have been disclosed in Japanese Laid-Open Patent Publications Nos. 5-158250 and 6-51544, and the like.

The content of the charge transporting material in the charge transporting layer 17 is from 20 to 300 parts by weight, and preferably from 40 to 150 parts by weight, per 100 parts by weight of the binder resin included in the charge transporting layer 17. In addition, the thickness of the charge transporting layer 17 is preferably from 5 to 50 $\mu$m.

Specific examples of the solvent for use in the charge transporting layer coating liquid include tetrahydrofuran, dioxane, toluene, monochlorobenzene, dichloroethane, dichloromethane, cyclohexanone, methyl ethyl ketone, acetone and the like.

The charge transporting layer 17 may includes a leveling agent. Specific examples of the leveling agent include silicone oils such as dimethyl silicone oils and methyl phenyl silicone oils, and polymers and oligomers including a perfluoroalkyl group in their side chains. The content of the leveling agent is from 0 to 1 part by weight per 100 parts by weight of the binder resin included in the charge transporting layer 17.

The intermediate layer 13 may include a particulate pigment such as metal oxides, e.g., titanium oxides, aluminum oxides, silica, zirconium oxides, tin oxides, indium oxides and the like; and silane coupling agents, titanium coupling agents, chromium coupling agents, titanyl chelate compounds, zirconium chelate compounds, titanylalkoxide compounds, and organic titanyl compounds to prevent occurrence of moiré in recorded images and to decrease the residual potential of the photoconductor.

The intermediate layer 13 preferably includes at least titanium oxide and a binder resin. This is because titanium oxide has a large refractive index so that the occurrence of moiré can be avoided, and has proper electroconductivity so that the residual potential can be decreased without causing troubles in charge properties of the resultant photoconductor.

The intermediate layer 13 can also be formed by the same method as mentioned above for use in the photoconductive layer, i.e., by coating a coating liquid in which one or more of the materials mentioned above are dispersed in a proper solvent, and drying the coated liquid using a proper coating method.

The thickness of the intermediate layer 13 is preferably from 0 to 10 $\mu$m.

The protective layer 21 is formed to improve the durability of the photoconductor. Specific examples of the materials for use in the protective layer 21 include ABS resins, ACS resins, olefin-vinyl monomer copolymers, chlorinated polyethers, aryl resins, phenolic resins, polyacetal resins, polyamide resins, polyamideimide resins, polyacrylate resins, polyarylsulfone resins, polybutylene resins, polybutyleneterephthalate resins, polycarbonate resins, polyethersulfone resins, polyethylene resins, polyethyleneterephthalate resins, polyimide resins, acrylic resins, polymethylpentene resins, polypropylene resins, polyphenylene oxide resins, polysulfone resins, polystyrene resins, As resins, butadiene-styrene copolymers, polyurethane resins, polyvinyl chloride resins, polyvinylidene chloride resins, epoxy resins and the like.

The protective layer 21 may include a lubricating resin such as fluorine-containing resins like polytetrafluoroethylene and silicone resins, and an inorganic material such as titanium oxides, tin oxides, potassium titanate and the like, to improve the abrasion resistance of the photoconductor.

The protective layer 21 can be formed by a general coating method. The thickness of the protective layer 21 is from 0.1 to 10 $\mu$m.

In addition, a layer of amorphous carbon or amorphous silicon carbide, which is formed by a thin film forming method performed in vacuum, can also be used as the intermediate layer 13.

In the electrophotographic image forming apparatus of the present invention, at least a charging process, an imagewise light irradiating process, a developing process, an image transfer process, a cleaning process are performed. Known methods and devices can be used for these processes. Namely, for example, a non-contact charging method such as corotron charging and scorotron charging using corona discharging, and a contact charging method such as roller charging using an electroconductive roller, and a brush charging can be used for the charging process. In the developing process, a reversal developing method (the area irradiated with imagewise light is developed with developer) using a one component developer, which may be magnetic or non-magnetic, or a two component developer can be performed. In the image transfer process, known image transfer methods such as methods using corona charging and methods using a transfer roller can be used. Blade cleaning methods are typically used for the cleaning process. In addition, a developing device may serve as a cleaning device.

A process cartridge which is constituted of a plurality of members such as a photoconductor, a developing device, a cleaning device and the like can also be provided in the image forming apparatus such that the cartridge can be freely set in or removed from the image forming apparatus.

Figure 4:
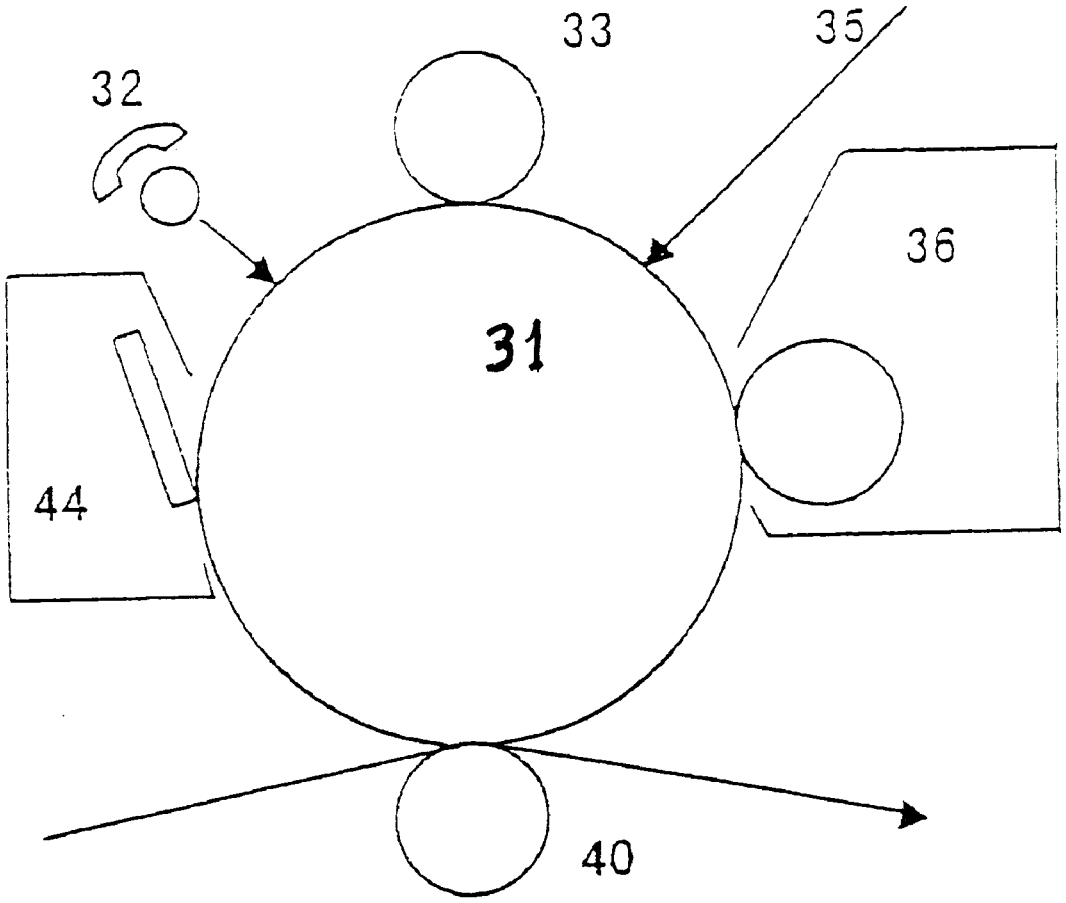
FIG. 4 is a schematic view illustrating a main part of an embodiment of the image forming apparatus of the present invention.

FIG. 4 is a schematic view illustrating a main part of an embodiment of the image forming apparatus of the present invention. Around the peripheral surface of a photoconductor 31 of the present invention, a light irradiating device 32 for removing the residual potential of the photoconductor 31, a charger 33 for charging the photoconductor 31, an imagewise light irradiating device 35 for irradiating the photoconductor 31 with imagewise light to form an electrostatic latent image thereon, a developing unit 36 for developing the latent image with a toner to form a toner image on the photoconductor 31, a transfer/separation charger 40 for transferring the toner image onto a receiving material, and a cleaning unit 44 for cleaning the photoconductor 31, are clockwise provided in this order.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

Formation of Intermediate Layer

The following components were mixed and dispersed for 72 hours using a ball mill to prepare an intermediate layer coating liquid.

| | |
|---|---|
| Titanium dioxide (CR-EL, manufactured by Ishihara Sangyo Kaisha Ltd.) | 70 |
| Alkyd resin (Bekkolite M6401-50-S, manufactured by Dainippon Ink and Chemicals, Inc., solid content of 50% by weight) | 15 |
| Melamine resin (Super Bekkamin L-121-60, manufactured by Dainippon Ink and Chemicals, Inc., solid content of 60% by weight) | 10 |
| methyl ethyl ketone | 100 |

The intermediate layer coating liquid was coated on the peripheral surface of an aluminum drum having a diameter of 80 mm and a length of 359 mm, and dried for 20 minutes at 130° C. to form an intermediate layer having a dry thickness of 4.5 μm.

Formation of Charge Generating Layer

The following components were mixed and dispersed for 72 hours using a ball mill to prepare a dispersion.

| | |
|---|---|
| Asymmetric disazo pigment having the following formula (IV) | 4.0 |
| τ-type metal-free phthalocyanine pigment | 2.0 |
| Polyvinyl butyral solution | 152.4 |

(IV)

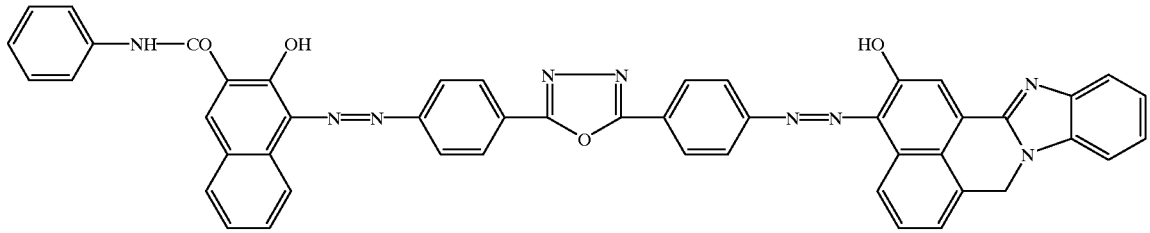

(2.4 parts by weight of S-lec BL-1, which had a butyralation degree of 63% by mole and which was manufactured by Sekisui Chemical Co., Ltd., was dissolved in 150 parts by weight of cyclohexanone)

Then the dispersion was mixed with 210 parts by weight of cyclohexanone, and additionally dispersed by the ball mill for 3 hours to prepare a charge generating layer coating liquid.

The charge generating layer coating liquid was coated on the above-prepared intermediate layer and dried for 10 minutes at 130° C. to form a charge generating layer having a dry thickness of 0.25 μm.

Formation of Charge Transporting Layer

The following component were mixed and dissolved to prepare a charge transporting layer coating liquid.

| | |
|---|---|
| Charge transporting material having the following formula (V) | 7 |
| Z type polycarbonate (viscosity average molecular weight of 30,000) | 10 |
| Silicone oil (KF-50, manufactured by Shin-Etsu Chemical Co., Ltd.) | 0.002 |
| Tetrahydrofuran | 100 |

(V)

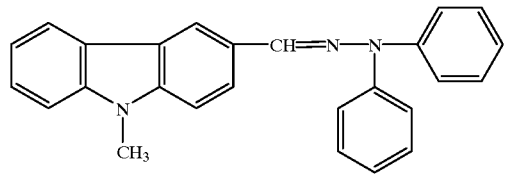

The charge transporting layer coating liquid was coated on the above-prepared charge generating layer, and dried for 15 minutes at 130° C. to form a charge transporting layer having a dry thickness of 25 μm.

Thus, a drum-shaped functionally-separated multilayer photoconductor of the present invention was prepared.

Example 2

The procedure for preparation of the photoconductor in Example 1 was repeated except that the charge transporting material having formula (V) in the charge transporting layer coating liquid was replaced with a compound having the following formula (VI).

(VI)

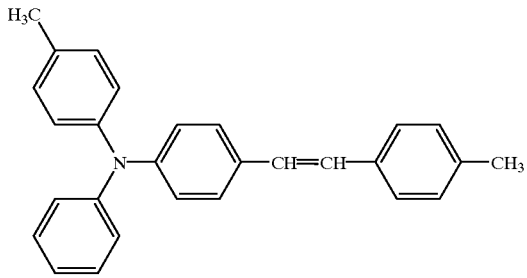

Example 3

The procedure for preparation of the photoconductor in Example 1 was repeated except that the charge transporting material having formula (V) in the charge transporting layer coating liquid was replaced with a compound having the following formula (VII).

(VII)

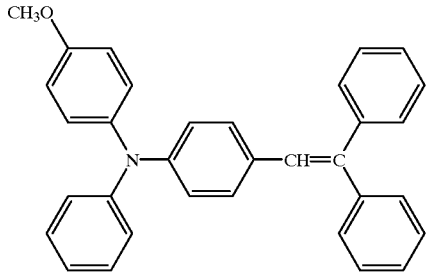

Examples 4 to 7, Comparative Examples 1 and 2

The procedure for preparation of the photoconductor in Example 1 was repeated except that the charge transporting material, the metal-free phthalocyanine pigment and its addition amount were changed as shown in Table 3. In addition, as shown in Table 3, the addition amount of the binder resin (polyvinyl butyral) in the charge generating layer coating liquid was also changed so that the ratio of the charge generating material (metal-free phthalocyanine and asymmetric disazo pigment) to the binder resin in the charge generating layer was 2.5:1 by weight.

TABLE 3

| | Phthalo-cyanine pigment | Addition amount of phthalo-cyanine pigment (g) | Addition amount of the binder resin in charge generating layer | Charge transporting material |
|---|---|---|---|---|
| Ex. 4 | τ type metal-free phthalo-cyanine | 2.6 | 2.64 | compound having formula (V) |
| Ex. 5 | τ type metal-free phthalo-cyanine | 0.8 | 1.92 | compound having formula (V) |
| Ex. 6 | X type metal-free phthalo-cyanine | 2.0 | 2.4 | compound having formula (VI) |
| Ex. 7 | X type metal-free phthalo-cyanine | 2.0 | 2.4 | compound having formula (VII) |
| Comp. Ex. 1 | τ type metal-free phthalo-cyanine | 4.0 | 3.2 | compound having formula (V) |
| Comp. Ex. 2 | τ type metal-free phthalo-cyanine | 0.5 | 1.8 | compound having formula (V) |

Each of the photoconductors prepared in Examples 1–7 and Comparative Examples 1–2 was evaluated by the following method:

(1) Image qualities

A photoconductor was set in a digital copier IMAGIO MF530 (manufactured by Ricoh Co., Ltd.) in which a filter of having a ND of 0.5 was provided in imagewise light irradiating device so that the quantity of light was reduced by half.

A continuous copying test, in which an image including black solid images whose area was 5% in the image was reproduced 50,000 times, was performed under a condition of 25° C. and 50% RH. The reproduced images were visually observed to determine whether there are undesirable images such as decrease of image density and background fouling. In addition, the reproduced images were visually observed to determine whether there are black spots having a size greater than 0.1 mm in the background of the images in an amount of not less than 1 piece per one square centimeter.

(2) Light resistance

A photoconductor was set in the digital copier IMAGIO MF530, and at first the potential —VD at an area of the photoconductor which was not exposed to imagewise light and the potential —VL at an area of the photoconductor which was exposed to imagewise light were measured using a potential meter. Then the photoconductor was removed from the copier and exposed to light of 1000 lux radiated from a fluorescent lamp for 30 minutes. Measurements of the potentials —VD and —VL were also performed after the light irradiation test to obtain —VD' and —VL'. The light resistance of the photoconductor was evaluated by checking ⊿VD (i.e., VD'–VD) and ⊿VL (i.e., VL'–VL).

The results are shown in Table 4.

TABLE 4

| | Black spots | Undesirable images | Light resistance ⊿VD | Light resistance ⊿VL |
|---|---|---|---|---|
| Ex. 1 | not observed | image density slightly decreased | −35 | 30 |
| Ex. 2 | not observed | image density slightly decreased | −30 | −5 |
| Ex. 3 | not observed | image density slightly decreased | −30 | −5 |
| Ex. 4 | not observed | image density slightly decreased | −30 | 30 |
| Ex. 5 | not observed | not observed | −35 | 30 |
| Ex. 6 | not observed | image density slightly decreased | −30 | −5 |
| Ex. 7 | not observed | image density slightly decreased | −30 | −5 |
| Comp. Ex. 1 | observed from 25000th image | image density slightly decreased | −80 | 40 |
| Comp. Ex. 2 | observed from 25000th image | image density decreased | −100 | 30 |

Examples 8 and 9

The procedure for preparation of the photoconductor in Example 1 was repeated except that the asymmetric disazo compound was replaced with a compound having the following formulae (VIII) or (IX).

(VIII)

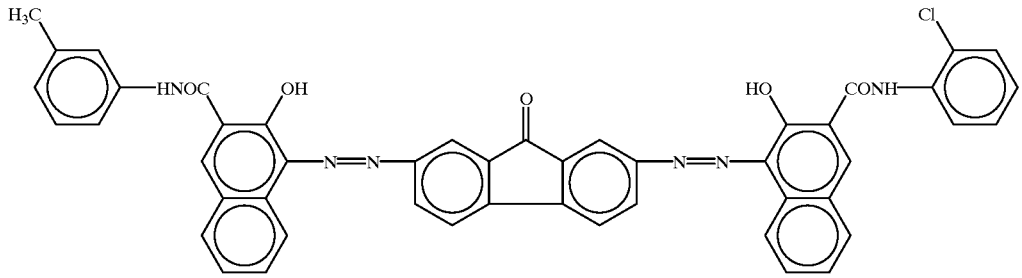

(IX)

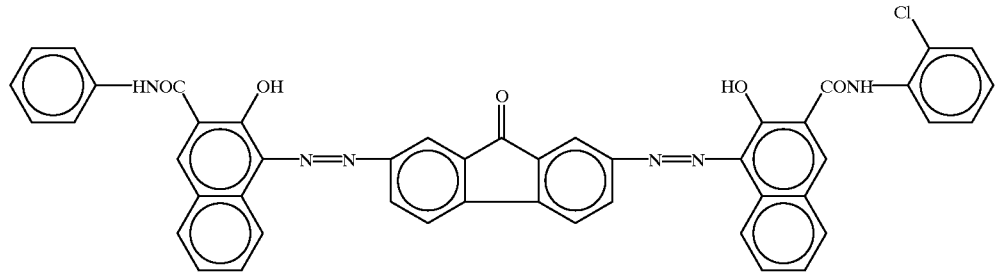

Examples 10 to 15, Comparative Examples 3 to 6

The procedure for preparation of the photoconductor in Example 1 was repeated except that the asymmetric disazo pigment, the metal-free phthalocyanine pigment and its addition amount, and the charge transporting material were changed as shown in Table 5. In addition, as shown in Table 5, the addition amount of the binder resin (polyvinyl butyral) in the charge generating layer coating liquid was also changed so that the ratio of the charge generating material to the binder resin in the charge generating layer was 2.5:1 by weight.

TABLE 5

| | Disazo pigment | Metal-free phthalo-cyanine pigment | Addition amount of Phthalo-cyanine pigment | Addition amount of poly-vinyl butyral | Charge trans-porting material |
|---|---|---|---|---|---|
| Ex. 10 | Formula (VIII) | τ type | 2.0 | 2.4 | Formula (VII) |
| Ex. 11 | Formula (VIII) | τ type | 2.6 | 2.64 | Formula (VII) |
| Ex. 12 | Formula (VIII) | τ type | 0.8 | 1.92 | Formula (VII) |
| Ex. 13 | Formula (IX) | X type | 2.0 | 2.4 | Formula (VII) |
| Ex. 14 | Formula (IX) | X type | 2.6 | 2.64 | Formula (VII) |
| Ex. 15 | Formula (IX) | X type | 0.8 | 1.92 | Formula (VII) |
| Comp. Ex. 3 | Formula (VIII) | τ type | 4.0 | 3.2 | Formula (VII) |
| Comp. Ex. 4 | Formula (VIII) | τ type | 0.5 | 1.8 | Formula (VII) |
| Comp. Ex. 5 | Formula (IX) | X type | 4.0 | 3.2 | Formula (VII) |
| Comp. Ex. 6 | Formula (IX) | X type | 0.5 | 1.8 | Formula (VII) |

The photoconductors of Examples 10 to 15 and Comparative Examples 3 to 6 were evaluated by the same methods as mentioned above.

The results are shown in Table 6.

TABLE 6

| | Black spots | Undesirable images | Light resistance ΔVD | Light resistance ΔVL |
|---|---|---|---|---|
| Ex. 8 | not observed | not observed | −10 | 20 |
| Ex. 9 | not observed | not observed | −10 | 20 |
| Ex. 10 | not observed | not observed | −5 | −5 |
| Ex. 11 | not observed | not observed | −5 | −5 |
| Ex. 12 | not observed | not observed | −10 | −10 |
| Ex. 13 | not observed | not observed | −5 | −5 |
| Ex. 14 | not observed | not observed | −5 | −5 |
| Ex. 15 | not observed | not observed | −10 | −10 |
| Comp. Ex. 3 | observed from 35000th image | image density decreased | −50 | −20 |
| Comp. Ex. 4 | observed from 40000th image | image density slightly decreased | −60 | −30 |
| Comp. Ex. 5 | observed from 35000th image | image density decreased | −50 | −20 |
| Comp. Ex. 6 | observed from 40000th image | image density slightly decreased | −60 | −30 |

Example 16

Formation of Intermediate Layer

The procedure for preparation of the intermediate layer in Example 1 was repeated. Thus, an intermediate layer was formed on an aluminum drum.

Formation of Charge Generating Layer

The following components were mixed and dispersed for 72 hours using a ball mill to prepare a dispersion.

| | |
|---|---|
| Asymmetric disazo pigment having the following formula (X) | 4.0 |

(X)

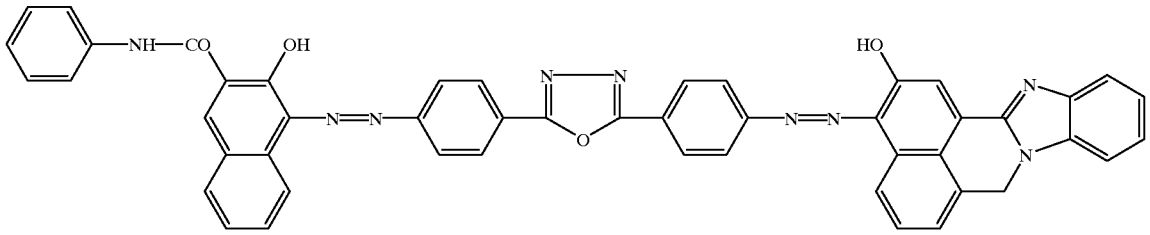

| | |
|---|---|
| τ-type metal-free phthalocyanine pigment | 2.0 |
| Polyvinyl butyral solution (1.2 parts by weight of a butyral resin, which has a butyralation degree of 60% by mole, was dissolved in 150 parts by weight of cyclohexanone) | 151.2 |

Then the dispersion was mixed with 210 parts by weight of cyclohexanone, and additionally dispersed using the ball mill for 3 hours to prepare a charge generating layer coating liquid.

The charge generating layer coating liquid was coated on the above-prepared intermediate layer and dried for 10 minutes at 130° C. to form a charge generating layer having a dry thickness of 0.25 μm.

Formation of Charge Transporting Layer

The following component were mixed and dissolved to prepare a charge transporting layer coating liquid.

| | |
|---|---|
| Charge transporting material having formula (VI) | 7 |
| Z type polycarbonate (viscosity average molecular weight of 30,000) | 10 |
| Silicone oil (KF-50, manufactured by Shin-Etsu Chemical Co., Ltd.) | 0.002 |
| Tetrahydrofuran | 100 |

The charge transporting layer coating liquid was coated on the above-prepared charge generating layer, and dried for 15 minutes at 130° C. to form a charge transporting layer having a dry thickness of 25 μm.

Thus, a drum-shaped functionally-separated multilayer photoconductor of the present invention was prepared.

Examples 17 to 25, Comparative Examples 7 and 8

The procedure for preparation of the photoconductor in Example 16 was repeated except that the addition amount of the polyvinyl butyral resin, the polyvinyl butyral resin (butyralation degree was changed), and the phthalocyanine pigment were changed as shown in Table 7.

TABLE 7

| | Addition amount of polyvinyl butyral (g) | Butyralation degree of butyral resin (% by mole) | Metal-free phthalocyanine pigment |
|---|---|---|---|
| Ex. 17 | 0.8 | 60 | τ type |
| Ex. 18 | 2.0 | 60 | τ type |
| Ex. 19 | 1.2 | 55 | τ type |
| Ex. 20 | 1.2 | 65 | τ type |

TABLE 7-continued

| | Addition amount of polyvinyl butyral (g) | Butyralation degree of butyral resin (% by mole) | Metal-free phthalocyanine pigment |
|---|---|---|---|
| Ex. 21 | 1.2 | 60 | X type |
| Ex. 22 | 0.8 | 60 | X type |
| Ex. 23 | 2.0 | 60 | X type |
| Ex. 24 | 1.2 | 55 | X type |
| Ex. 25 | 1.2 | 65 | X type |
| Comp. Ex. 7 | 0.6 | 60 | τ type |
| Comp. Ex. 8 | 3.0 | 60 | τ type |

Comparative Examples 9 and 10

The procedures for preparation of the photoconductors in Examples 16 and 21 were repeated except that the polyvinyl butyral resin was replaced with a polyester resin (Vylon 200 manufactured by Toyobo Co., Ltd.

Thus, two comparative photoconductors of Comparative Examples 9 and 10 were prepared.

The thus prepared photoconductors were evaluated in the same way as mentioned above except that the light resistant test was not performed.

The potentials —VD and —VL were also measured after the continuous copying test.

The results are shown in Table 8.

TABLE 8

| | Initial value | | After continuous copying test | | | |
|---|---|---|---|---|---|---|
| | VD (−V) | VL (−V) | VD (−V) | VL (−V) | Black spots | Undesirable images |
| Ex. 16 | 830 | 225 | 715 | 250 | observed from 46000th image | not observed |
| Ex. 17 | 830 | 225 | 700 | 240 | observed from 38000th image | not observed |

TABLE 8-continued

| | Initial value | | After continuous copying test | | | |
|---|---|---|---|---|---|---|
| | VD (−V) | VL (−V) | VD (−V) | VL (−V) | Black spots | Undesirable images |
| Ex. 18 | 840 | 230 | 710 | 250 | observed from 45000th image | not observed |
| Ex. 19 | 845 | 240 | 710 | 260 | observed from 46000th image | not observed |
| Ex. 20 | 820 | 220 | 690 | 245 | observed from 38000th image | faint fouling |
| Ex. 21 | 835 | 220 | 700 | 235 | observed from 44000th image | not observed |
| Ex. 22 | 830 | 220 | 680 | 225 | observed from 37000th image | faint fouling |
| Ex. 23 | 845 | 225 | 700 | 230 | observed from 43000th image | not observed |
| Ex. 24 | 845 | 230 | 700 | 240 | observed from 44000th image | not observed |
| Ex. 25 | 825 | 215 | 680 | 230 | observed from 37000th image | faint fouling |
| Comp. Ex. 7 | 820 | 220 | 560 | 220 | observed from 22000th image | fouling |
| Comp. Ex. 8 | 845 | 235 | 720 | 340 | observed from 31000th image | image density decreased |
| Comp. Ex. 9 | 810 | 220 | 530 | 250 | observed from 15000th image | fouling |
| Comp. Ex. 10 | 815 | 210 | 520 | 230 | observed from 13000th image | fouling |

Examples 26 and 27

The procedure for preparation of the photoconductor in Example 16 was repeated except that the asymmetric disazo pigment was replaced with a compound having the following formula (XI) or (XII). Thus, two photoconductors of Examples 26 and 27 were prepared.

(XI)

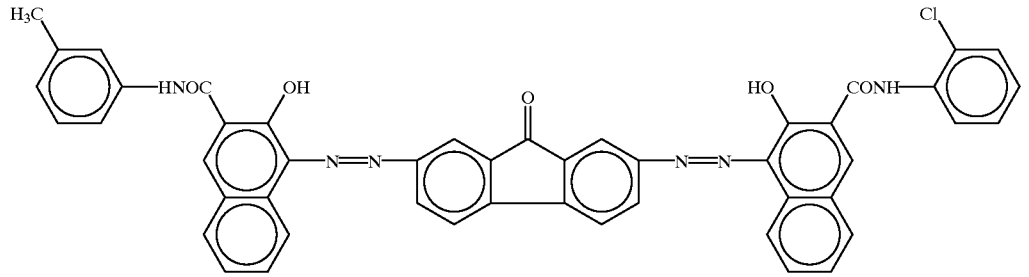

Examples 28 to 42, Comparative Examples 11 to 22

The procedure for preparation of the photoconductor in Example 16 was repeated except that the asymmetric disazo pigment, the addition amount of the polyvinyl butyral resin, the polyvinyl butyral resin (butyralation degree was changed), and the phthalocyanine pigment were changed as shown in Table 9. Thus, photoconductors of the present invention of Examples 28 to 42 and comparative photoconductors of Comparative Examples 11 to 22 were prepared.

TABLE 9

| | Asymmetric disazo pigment | Addition amount of polyvinyl butyral (g) | Butyralation degree of polyvinyl butyral resin (% by mole) | Metal-free phthalocyanine pigment |
|---|---|---|---|---|
| Ex. 28 | Formula (XI) | 0.8 | 60 | τ type |
| Ex. 29 | Formula (XI) | 2.0 | 60 | τ type |
| Ex. 30 | Formula (XI) | 1.2 | 55 | τ type |
| Ex. 31 | Formula (XI) | 1.2 | 65 | τ type |
| Ex. 32 | Formula (XI) | 1.2 | 60 | X type |
| Ex. 33 | Formula (XI) | 0.8 | 60 | X type |
| Ex. 34 | Formula (XI) | 2.0 | 60 | X type |
| Ex. 35 | Formula (XII) | 1.2 | 60 | X type |
| Ex. 36 | Formula (XII) | 0.8 | 60 | X type |
| Ex. 37 | Formula (XII) | 2.0 | 60 | X type |
| Ex. 38 | Formula (XII) | 1.2 | 55 | X type |
| Ex. 39 | Formula (XII) | 1.2 | 65 | X type |
| Ex. 40 | Formula (XII) | 0.8 | 60 | τ type |
| Ex. 41 | Formula (XII) | 2.0 | 60 | τ type |
| Comp. Ex. 11 | Formula (XI) | 0.6 | 60 | τ type |
| Comp. Ex. 12 | Formula (XI) | 3.0 | 60 | Z type |
| Comp. Ex. 13 | Formula (XI) | (1.2) (Vylon 200) | 60 | τ type |
| Comp. Ex. 14 | Formula (XI) | 0.6 | 60 | X type |
| Comp. Ex. 15 | Formula (XI) | 3.0 | 60 | X type |
| Comp. Ex. 16 | Formula (XI) | (1.2) (Vylon 200) | 60 | X type |
| Comp. Ex. 17 | Formula (XI) | 0.6 | 60 | τ type |
| Comp. Ex. 18 | Formula (XI) | 3.0 | 60 | τ type |
| Comp. Ex. 19 | Formula (XI) | (1.2) (Vylon 200) | 60 | τ type |
| Comp. Ex. 20 | Formula (XI) | 0.6 | 60 | X type |
| Comp. Ex. 21 | Formula (XI) | 3.0 | 60 | X type |
| Comp. Ex. 22 | Formula (XI) | (1.2) (Vylon 200) | 60 | X type |

The photoconductors were evaluated in the same way as formed in Example 1.

The results are shown in Table 10.

TABLE 10

| | Initial value | | After continuous copying test | | | |
|---|---|---|---|---|---|---|
| | VD (−V) | VL (−V) | VD (−V) | VL (−V) | Black spots | Undesirable images |
| Ex. 26 | 850 | 130 | 765 | 150 | not observed | not observed |
| Ex. 27 | 850 | 135 | 765 | 150 | not observed | not observed |
| Ex. 28 | 845 | 125 | 755 | 145 | not observed | not observed |
| Ex. 29 | 855 | 135 | 770 | 155 | not observed | not observed |
| Ex. 30 | 855 | 135 | 775 | 155 | not observed | not observed |
| Ex. 31 | 845 | 125 | 755 | 140 | observed from 48000th image | not observed |
| Ex. 32 | 850 | 125 | 765 | 145 | not observed | not observed |
| Ex. 33 | 845 | 120 | 760 | 140 | not observed | not observed |
| Ex. 34 | 855 | 130 | 770 | 145 | not observed | not observed |
| Ex. 35 | 850 | 135 | 765 | 150 | not observed | not observed |
| Ex. 36 | 845 | 130 | 755 | 145 | not observed | not observed |
| Ex. 37 | 855 | 135 | 765 | 155 | not observed | not observed |
| Ex. 38 | 860 | 140 | 770 | 155 | not observed | not observed |
| Ex. 39 | 840 | 135 | 745 | 140 | observed from 46000th image | fouling |
| Ex. 40 | 845 | 130 | 755 | 145 | not observed | not observed |
| Ex. 41 | 850 | 125 | 770 | 155 | not observed | not observed |
| Comp. Ex. 11 | 840 | 130 | 660 | 125 | observed from 32000th image | fouling |
| Comp. Ex. 12 | 850 | 150 | 840 | 220 | observed from 36000th image | not observed |
| Comp. Ex. 13 | 835 | 135 | 650 | 130 | observed from 30000th image | fouling |
| Comp. Ex. 14 | 840 | 140 | 645 | 135 | observed from 31000th image | fouling |
| Comp. Ex. 15 | 850 | 160 | 835 | 220 | observed from 35000th image | not observed |
| Comp. Ex. 16 | 835 | 145 | 635 | 140 | observed from 29000th image | fouling |

TABLE 10-continued

| | Initial value | | After continuous copying test | | | |
|---|---|---|---|---|---|---|
| | VD (−V) | VL (−V) | VD (−V) | VL (−V) | Black spots | Undesirable images |
| Comp. Ex. 17 | 840 | 130 | 669 | 140 | observed from 33000th image | fouling |
| Comp. Ex. 18 | 850 | 150 | 840 | 210 | observed from 37000th image | not observed |
| Comp. Ex. 19 | 835 | 135 | 650 | 130 | observed from 31000th image | fouling |
| Comp. Ex. 20 | 840 | 140 | 640 | 135 | observed from 31000th image | fouling |
| Comp. Ex. 21 | 850 | 165 | 840 | 220 | observed from 35000th image | none |
| Comp. Ex. 22 | 835 | 150 | 635 | 135 | observed from 29000th image | fouling |

In addition, the photoconductors were evaluated with respect to the adhesion property of the photoconductive layer (including the intermediate layer, charge generating layer and charge transporting layer) to the substrate. The adhesion property was evaluated by the following method.

The adhesion property was evaluated by a method based on JIS G0202 (cross cut test method). An area of 1 $cm^2$ of each photoconductive layer was horizontally and vertically cut with a knife at equally spaced intervals of 2 mm, respectively (i.e., twenty-five cut parts of 2 mm×2 mm were formed). A tape was adhered to the cut parts of the photoconductor and then the tape was peeled. The cut parts were visually observed to determine how many cut parts remained at their positions.

The results are shown in Table 11. When the remaining cut parts are not less than 15, there is no practical problem with respect to the adhesion.

TABLE 11

| | Remaining cut parts |
|---|---|
| Ex. 26 | 20 |
| Ex. 27 | 20 |
| Ex. 28 | 18 |
| Ex. 29 | 22 |
| Ex. 30 | 25 |
| Ex. 31 | 16 |
| Ex. 32 | 20 |
| Ex. 33 | 18 |
| Ex. 34 | 20 |
| Ex. 35 | 20 |
| Ex. 36 | 16 |
| Ex. 37 | 22 |

TABLE 11-continued

| | Remaining cut parts |
|---|---|
| Ex. 38 | 25 |
| Ex. 39 | 16 |
| Ex. 40 | 18 |
| Ex. 41 | 22 |
| Comp. Ex 11 | 0 |
| Comp. Ex 12 | 18 |
| Comp. Ex 13 | 0 |
| Comp. Ex 14 | 0 |
| Comp. Ex 15 | 18 |
| Comp. Ex 16 | 0 |
| Comp. Ex 17 | 0 |
| Comp. Ex 18 | 19 |
| Comp. Ex 19 | 0 |
| Comp. Ex 20 | 0 |
| Comp. Ex 21 | 18 |
| Comp. Ex 22 | 0 |

As can be understood from Tables, the photoconductors of the present invention have good charge properties, good light resistance and good adhesion, and the electrophotographic image forming apparatus of the present invention can reproduce images having good image qualities even when continuously copied for a long time.

Having now fully described the invention, it will be apparent to one of ordinary skill in the art that man changes and modifications can be made thereto without departing from the spirit and scope of the invention as set forth therein.

This application is based on Japanese Patent Applications Nos. 10-256120 and 10-269078, filed on Aug. 27, 1998, and Sep. 8, 1998,respectively, incorporated herein by reference.

What is claimed as new and desired to be secured by Letters Patent of the United States is:

1. An electrophotographic photoconductor comprising an electroconductive substrate, and a charge generating layer including a charge generating material and a charge transporting layer including a charge transporting material, said charge generating layer and charge transporting layer being overlaid and formed overlying one side of the electroconductive substrate, wherein the charge generating material comprises an asymmetric disazo pigment and a metal-free phthalocyanine pigment, and wherein the ratio of the asymmetric disazo pigment to the metal-free phthalocyanine pigment is from 1.5:1 to 5:1 by weight and the asymmetric disazo pigment has the following formula (I):

$$Cp_1—N=N—A—N=N—Cp_2 \quad (I)$$

wherein A represents a divalent group which is connected to each nitrogen atom of the adjacent azo groups through a carbon atom of said A group; and $Cp_1$ and $Cp_2$ independently represents a residual group of a coupler, wherein $Cp_1$ is different from $Cp_2$.

2. The electrophotographic photoconductor of claim 1, wherein the charge generating layer further comprises a binder resin comprising a polyvinyl butyral resin, and wherein the ratio of the charge generating material to the binder resin is from 8:1 to 3:1 by weight.

3. The electrophotographic photoconductor of claim 2, wherein the butyral resin has a butyralation degree less than 62% by mole.

4. The electrophotographic photoconductor of claim 1, wherein the asymmetric disazo pigment comprises a compound having the following formula (II):

(II)

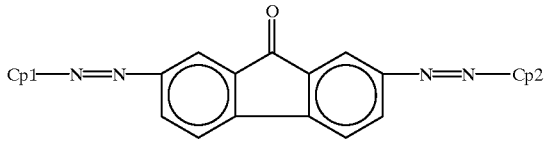

wherein Cp1 and Cp2 independently represent a residual group of a coupler, wherein Cp1 is different from Cp2.

5. The electrophotographic photoconductor of claim 1, wherein the metal-free phthalocyanine pigment comprises at least one of τ-type phthalocyanine and X-type phthalocyanine.

6. The electrophotographic photoconductor of claim 1, wherein the charge transporting layer further comprises a binder resin, and wherein the charge transporting material comprises a triphenylamine compound having the following formula (III):

(III)

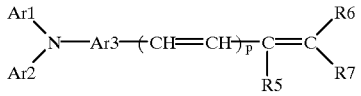

wherein Ar1 and Ar2 independently represent an aryl group which is optionally substituted, or an aromatic heterocyclic ring group which is optionally substituted; R5, R6 and R7 independently represent a hydrogen atom, an alkyl group which is optionally substituted, an alkoxy group which is optionally substituted, an aryl group which is optionally substituted, or a heterocyclic ring group which is optionally substituted, wherein R6 and R7 is optionally combined to form a ring; Ar5 represents an arylene group which is optionally substituted; and p is 0 or 1.

7. The electrophotographic photoconductor of claim 1, wherein the photoconductor further comprises an intermediate layer which is overlying the side of the substrate and which is closer to the substrate than the charge generating layer and the charge transporting layer, and wherein the intermediate layer comprises titanium oxide and a binder resin.

8. An electrophotographic image forming method comprising the steps of:

providing an electrophotographic photoconductor;

charging the electrophotographic photoconductor;

irradiating the electrophotographic photoconductor with imagewise light to form an electrostatic latent image on the electrophotographic photoconductor;

reversely developing the electrostatic latent image with a toner to form a toner image on the electrophotographic photoconductor;

transferring the toner image to a receiving material; and cleaning the electrophotographic photoconductor, wherein the electrophotographic photoconductor comprises an electraconductive substrate, and a charge generating layer including a charge generating material and a charge transporting layer including a charge transporting material, said charge generating layer and charge transporting layer being overlaid and formed overlying one side of the electroconductive substrate, wherein the charge generating material comprises an asymmetric disazo pigment and a metal-free phthalocyanine pigment, and wherein the ratio of the asymmetric disazo pigment to the metal-free phthalocyanine pigment is from 1.5:1 to 5:1 by weight and the asymmetric disazo pigment has the following formula (I):

$$Cp_1—N=N—A—N=N—Cp_2 \quad (I)$$

wherein A represents a divalent group which is connected to each nitrogen atom of the adjacent azo groups through a carbon atom of said A group; and Cp1 and Cp2 independently represents a residual group of a coupler, wherein Cp1 is different from Cp2.

9. An electrophotographic image forming apparatus comprising:

an electrophotographic photoconductor;

a charging device which charges the photoconductor so that the photoconductor has a predetermined potential;

an imagewise light irradiation device which irradiates the charged photoconductor with imagewise light to form an electrostatic latent image on the photoconductor;

a developing device which reversely develops the electrostatic latent image with a toner to form a toner image on the photoconductor;

an image transfer device which transfers the toner image to a receiving material; and a cleaning device which cleans the photoconductor, wherein the electrophotographic photoconductor comprises an electroconductive substrate, and a charge generating layer including a charge generating material and a charge transporting layer including a charge transporting material, said charge generating layer and charge transporting layer being overlaid and formed overlying one side of the electroconductive substrate, wherein the charge generating material comprises an asymmetric disazo pigment and a metal-free phthalocyanine pigment, and wherein the ratio of the asymmetric disazo pigment to the metal-free phthalocyanine pigment is from 1.5:1 to 5:1 by weight and the asymmetric disazo pigment has the following formula (I):

$$Cp_1—N=N—A—N=N—Cp_2 \quad (I)$$

wherein A represents a divalent group which is connected to each nitrogen atom of the adjacent azo groups through a carbon atom of said A group; and Cp1 and Cp2 independently represents a residual group of a coupler, wherein Cp1 is different from Cp2.

* * * * *